US010214861B2

(12) United States Patent
Hamilton et al.

(10) Patent No.: US 10,214,861 B2
(45) Date of Patent: Feb. 26, 2019

(54) RAILWAY TIE PLATE RETENTION DEVICES AND METHODS TO FACILITATE RAILWAY TIE REPLACEMENT

(71) Applicant: MOW Equipment Solutions, Inc., Linwood, KS (US)

(72) Inventors: William Michael Hamilton, Linwood, KS (US); Justin Wynne Tomac, Bonner Springs, KS (US); Ryan Jay Koci, Stilwell, KS (US)

(73) Assignee: MOW Equipment Solutions, Inc., Linwood, KS (US)

( * ) Notice: Subject to any disclaimer, the term of this patent is extended or adjusted under 35 U.S.C. 154(b) by 302 days.

(21) Appl. No.: 15/095,789

(22) Filed: Apr. 11, 2016

(65) Prior Publication Data

US 2016/0298299 A1 Oct. 13, 2016

Related U.S. Application Data

(60) Provisional application No. 62/145,706, filed on Apr. 10, 2015.

(51) Int. Cl.
*E01B 9/04* (2006.01)
*E01B 9/12* (2006.01)

(52) U.S. Cl.
CPC . *E01B 9/04* (2013.01); *E01B 9/12* (2013.01)

(58) Field of Classification Search
CPC ..... E01B 9/04; E01B 9/12; E01B 9/02; E01B 9/06; E01B 9/10; E01B 9/14
See application file for complete search history.

(56) References Cited

U.S. PATENT DOCUMENTS 1,621,768 A * 3/1927 Crippen ..... E01B 9/12 238/294

* cited by examiner

*Primary Examiner* — Mark T Le
(74) *Attorney, Agent, or Firm* — Kilpatrick Townsend & Stockton LLP

(57) ABSTRACT

Retention devices, and methods for retention devices, to retain a railway tie plate are disclosed. The retention devices may include a head section with one or more protrusions adapted to engage a railway rail. The retention devices may include an insert section adapted to fit in a spike hole of a railway tie plate and including one or more flexible members extending from the head section. Each flexible member may allow flex adjustment when the insert section is inserted in the spike hole of the railway tie plate. When the insert section is inserted in the spike hole of the railway tie plate, the head section may engage the railway rail and the insert section may engage the railway tie plate to mechanically interlock the railway tie plate with the railway rail to allow suspension of the railway tie plate from the railway rail.

16 Claims, 12 Drawing Sheets

RAILWAY TIE PLATE RETENTION DEVICES AND METHODS TO FACILITATE RAILWAY TIE REPLACEMENT

CROSS-REFERENCE TO RELATED APPLICATIONS

The present application claims benefit under 35 USC 119(e) of U.S. Provisional Application No. 62/145,706, filed on Apr. 10, 2015, by Hamilton et al. and entitled "Method and Apparatus for Railway Tie Plate Retention During Tie Replacement," the entire disclosure of which is incorporated herein by reference for all purposes.

BACKGROUND

Certain embodiments of the present disclosure relate generally to railways, and in particular to maintenance of way with apparatuses and methods for railway tie plate retention to facilitate railway tie replacement.

With the hundreds of thousands of miles of railroad track traversing the United States alone, in addition to the great lengths throughout other countries of the world, maintenance of way is a tremendous and important effort. One aspect of maintenance of way is railway tie maintenance. Railway ties are typically made of wood or other materials that age and deteriorate over time due to railway use and environmental conditions. As a result, railway ties eventually require replacement. When a railway tie has been removed with a tie removal machine, certain railway elements, such as tie plates, are no longer supported.

Under current work practices, the tie plate either falls into a cavity left by the absence of the removed railway tie or is displaced to a shoulder of a ballast outside a rail. A worker must then retrieve the tie plate from the cavity or the shoulder by hand and set the tie plate aside in a proximate location. All new railway ties must have a tie plate placed on them in order to secure the rail properly. The tie plates are normally re-used with new railway ties. Later in the tie replacement process, a worker must pick up the tie plate and place it into position with correct orientation on an outside edge of an new railway tie to allow a machine to lift the rail and push the tie plate into proper position underneath the rail. This process is typically performed by two gangs of workers walking along a track and ballast shoulder to manually handle tie plates. One gang retrieves and places tie plates in a temporary, proximate location; another gang places tie plates into position on outside edges of new ties so they may be inserted under the rail by a different machine later in the process. The work window is often 8-12 hours long and typically includes 2,000-5,000 ties that are replaced per day.

Several issues are presented by the process, including issues redounding in inefficiencies and risks for personal injury. Significant time is devoted to the manual retrieval and handling of tie plates, especially when considered in the aggregate. Moreover, workers must traverse significant distances of uneven surfaces of a railway, even surfaces that are exacerbated by disturbed track where gaping holes are left when railway ties are removed, in between large railway tie removal and replacement machines. Workers often must step into the holes and/or bend low to retrieve tie plates from the holes. It is also not uncommon for workers to be forced to make their way down shoulders of the railway to retrieve tie plates that have been cast down the shoulders. These activities present risks for back injuries, knee injuries, ankle injuries, among others that occur with current work practices.

Thus, there is a need to solve these problems and provide for apparatuses and methods for railway tie plate retention. These and other needs are addressed by the present disclosure.

BRIEF SUMMARY

Certain embodiments of the present disclosure relate generally to railways, and in particular to maintenance of way with apparatuses and methods for railway tie plate retention to facilitate railway tie replacement.

In one aspect, a retention device to retain a railway tie plate is disclosed. The retention device may include any one or combination of the following. A head section may include one or more protrusions adapted to engage a railway rail. An insert section may be adjacent to the head section. The insert section may be adapted to fit in a spike hole of a railway tie plate. The insert section may include one or more flexible members extending from the head section. Each flexible member may be adapted to allow flex adjustment having at least a lateral component with respect to a longitudinal axis to engage the railway tie plate when the insert section is inserted in the spike hole of the railway tie plate. When the insert section is inserted in the spike hole of the railway tie plate, the head section may engage the railway rail and the insert section may engage the railway tie plate to mechanically interlock the railway tie plate with the railway rail to allow suspension of the railway tie plate from the railway rail.

In another aspect, a method for a retention device to retain a railway tie plate is disclosed. The method may include any one or combination of the following. A head section may be formed, the head section including one or more protrusions adapted to engage a railway rail. An insert section adjacent to the head section may be formed. The insert section may be adapted to fit in a spike hole of a railway tie plate. The insert section may include one or more flexible members extending from the head section. Each flexible member may be adapted to allow flex adjustment having at least a lateral component with respect to a longitudinal axis to engage the railway tie plate when the insert section is inserted in the spike hole of the railway tie plate. The head section and the insert section may be adapted so that, when the insert section is inserted in the spike hole of the railway tie plate, the head section engages the railway rail and the insert section engages the railway tie plate to mechanically interlock the railway tie plate with the railway rail to allow suspension of the railway tie plate from the railway rail.

In yet another aspect, another method for a retention device to retain a railway tie plate is disclosed. The method may include any one or combination of the following. With a retention device, a railway tie plate may be mechanically interlocked with a railway rail to allow suspension of the railway tie plate from the railway rail. The retention device may include a head section including one or more protrusions adapted to engage a railway rail. The retention device may further include an insert section adjacent to the head section. The insert section may be adapted to fit in a spike hole of a railway tie plate. The insert section may include one or more flexible members extending from the head section. Each flexible member may be adapted to allow flex adjustment having at least a lateral component with respect to a longitudinal axis to engage the railway tie plate when the insert section is inserted in the spike hole of the railway tie plate. When the insert section is inserted in the spike hole of the railway tie plate, the head section may engage the railway rail and the insert section may engage the railway tie plate to mechanically interlock the railway tie plate with the railway rail to allow suspension of the railway tie plate from the railway rail.

In various embodiments, at least one flexible member of the one or more flexible members may include a medial section and a foot section. The foot section may be disposed generally opposite of the head section. The foot section may include a lateral protrusion laterally extending with respect to the medial section and adapted to engage an underside of the railway tie plate when the insert section is inserted in the spike hole of the railway tie plate.

In various embodiments, the one or more flexible members may correspond to at least two resilient spring members. Each resilient spring member may have a respective foot section. The at least two resilient spring members may be resilient to allow compression with respect to each other to allow insertion of each respective foot section into the spike hole of the railway tie plate and to allow expansion with respect to each other to allow each respective foot section to engage the underside of the railway tie plate when the respective foot sections extend beyond the spike hole of the railway tie plate.

In various embodiments, the head section and the insert section may be formed to at least partially define an internal bore adapted to allow a railway spike to pass through the internal bore and the spike hole of the railway tie plate when the head section and the insert section is inserted in the spike hole of the railway tie plate. In various embodiments, the insert section may be adapted to engage interior faces of the railway tie plate corresponding to the spike hole with pressure to create a friction fit.

In various embodiments, the retention device may include a push pin including a tapered shank. The head section and the insert section may be formed to define an internal tapered bore. The insert section may be formed to have an external taper. The insert section may engage the railway tie plate to mechanically interlock the railway tie plate based at least in part on insertion of the tapered shank into the internal tapered bore to cause at least a portion of the external taper to engage the interior faces of the railway tie plate corresponding to the spike hole to create the friction fit.

In various embodiments, the head section may include a nose section extending from a first side of the head section. The head section may further include a tail section disposed generally opposite of the nose section and extending from a second side of the head section. The head section engaging the railway rail may include engaging the railway rail with the nose section. The mechanical interlock may be based in part on the head section engaging the tie plate with the tail section. In various embodiments, the nose section may include a plurality of fins. The head section engaging the railway rail with the nose section may include engaging the railway rail with the plurality of fins.

Further areas of applicability of the present disclosure will become apparent from the detailed description provided hereinafter. It should be understood that the detailed description and specific examples, while indicating various embodiments, are intended for purposes of illustration only and are not intended to necessarily limit the scope of the disclosure.

BRIEF DESCRIPTION OF THE DRAWINGS

The present disclosure is described in conjunction with the following appended figures.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The ensuing description provides preferred exemplary embodiment(s) only, and is not intended to limit the scope, applicability, or configuration of the disclosure. Rather, the ensuing description of the preferred exemplary embodiment (s) will provide those skilled in the art with an enabling description for implementing a preferred exemplary embodiment of the disclosure. It should be understood that various changes may be made in the function and arrangement of elements without departing from the spirit and scope of the disclosure as set forth in the appended claims.

Certain embodiments according to the present disclosure may provide for a fastening system to fasten tie plates to a rail of a railway, thereby allowing an underlying railway tie to be removed while the tie plate is held in its original position. Thus, certain embodiments may enable a tie plate to be suspended in the absence of a railway tie underneath the tie plate to support the tie plate during removal of a corresponding railway tie and replacement with a new railway tie. According to some embodiments, the fastening system may be a temporary fastening system to retain tie plates against rails during a railway tie are removal and replacement process. For such embodiments, after a new railway tie is placed into final position, tie plate retention devices may be removed. However, with other embodiments, the fastening system may be a permanent fastening system to retain tie plates against rails before, during, and after a railway tie removal and replacement process. For such embodiments, tie plate retention devices need not be removed after a new railway tie is placed into final position. The tie plate retention devices may be configured to allow the tie plate to be secured to the new railway tie with the tie plate retention devices installed in the same railway spike holes through which railway spikes may be driven to secure the new railway tie.

Various embodiments will now be discussed in greater detail with reference to the accompanying figures, beginning with FIG. 1.

Figure 1:
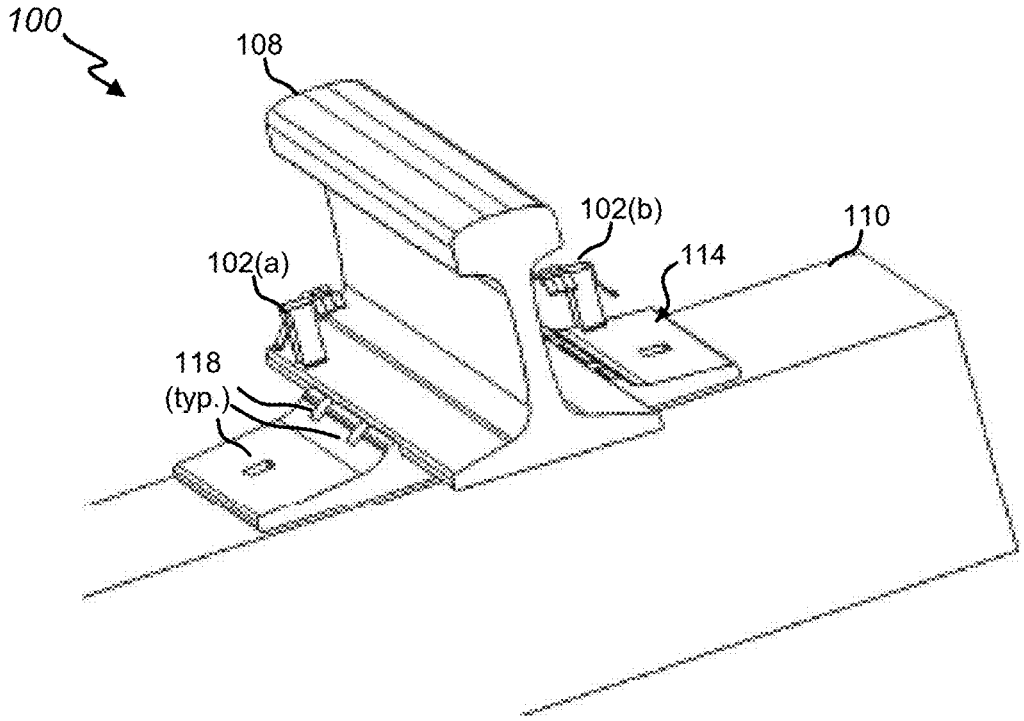
FIG. 1 depicts the perspective view of a railway portion with drive-through retention devices illustrated in relation to the railway portion, in accordance with certain embodiments of the present disclosure.
Figure 2:
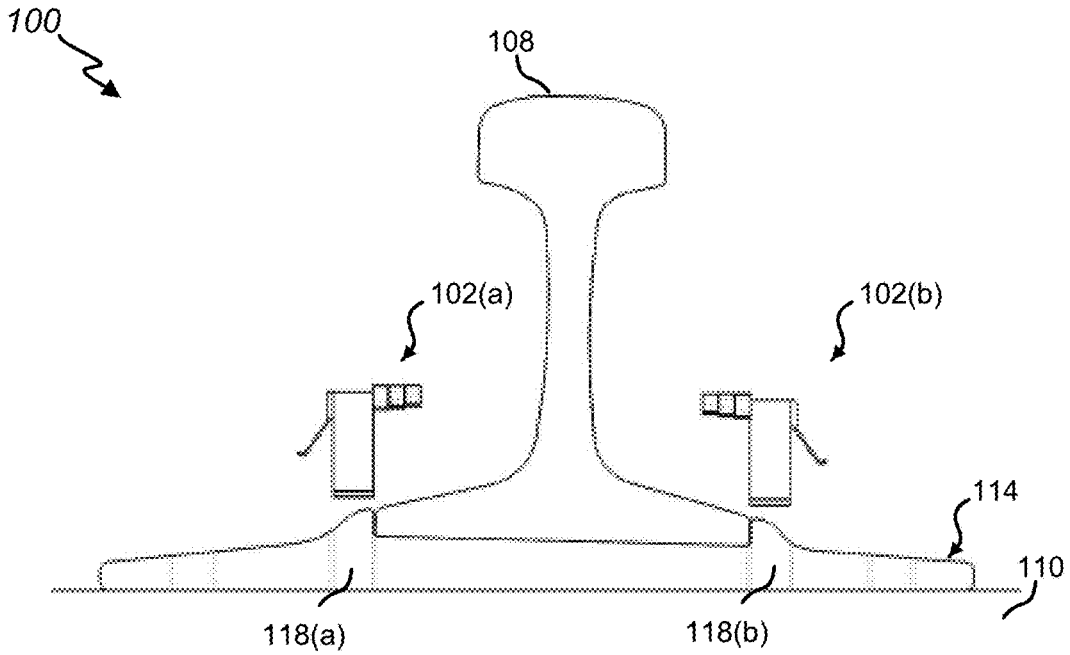
FIG. 2 depicts a partial cross-sectional view of the railway portion with drive-through retention devices illustrated in relation to the railway portion, in accordance with certain embodiments of the present disclosure.

FIG. 1 depicts the perspective view of a railway portion 100 with retention devices 102(*a*), 102(*b*) illustrated in relation to the railway portion 100, in accordance with certain embodiments of the present disclosure. FIG. 2 depicts a partial cross-sectional view of the railway portion 100 with retention devices 102(*a*), 102(*b*) illustrated in relation to the railway portion 100, in accordance with certain embodiments of the present disclosure. The depicted railway portion 100 illustrates a rail 108 supported by a railway tie 110 and a tie plate 114. The tie plate 114 is illustrated in a typical position when spiked into place in their normal position underneath the rail 108. Though not explicitly depicted, the railway corresponding to the railway portion 100 may include a pair of rails 108 supported by a plurality of railway ties 110 and fastened to the railway ties 110 with a combination of railway spikes (not shown), tie plates 114 fastened to the railway ties 110 with the railway spikes driven through spike holes 118 of the tie plates 114. Not all spike holes 118 are used when tie plates 114 are spiked into place on the railway ties 110.

As used herein, the term "gage side" is used to indicate an association with a space between the pair of rails 108 and/or a side of a rail 108 or other component exposed to, facing, and/or oriented toward the space between the pair of rails 108. The term "field side" is used to indicate an association with a space external to the pair of rails 108 and/or a side of a rail 108 or other component exposed to, facing, and/or oriented toward the space external to the pair of rails 108. The rails of a railway are typically designed and installed to have a slight tilt (e.g., approximately 1.4°) toward the gage side. This is illustrated more clearly by FIG. 2.

In the example depicted, the drive-through retention device 102(*a*) is shown on a field side of the rail 108, while the drive-through retention device 102(*b*) is shown on a gage side of the rail 108. Likewise, spike holes 118(*a*) correspond to a field side of the tie plate 114, and spike holes 118(*b*) correspond to a gage side of the tie plate 114. Due the cant of the rail 108 and the tie plate 114, the field side of the tie plate 114 has a portion next the base of the rail 108 that is taller than a corresponding portion of the gage side of the tie plate 114 next to the gage side of the base of the rail 108. As a result, the spike holes defined by those portions have different lengths. Hence, the field-side spike hole 118(*a*) is illustrated as being longer than the gage-side spike hole 118(*b*).

For the sake of explanation, the retention devices 102(*a*), 102(*b*) are illustrated as suspended above corresponding spike holes 118(*a*), 118(*b*). In practice, however, retention devices according to various embodiments of this disclosure may be handled and/or installed automatically with special purpose machinery in some embodiments.

Figure 3B:
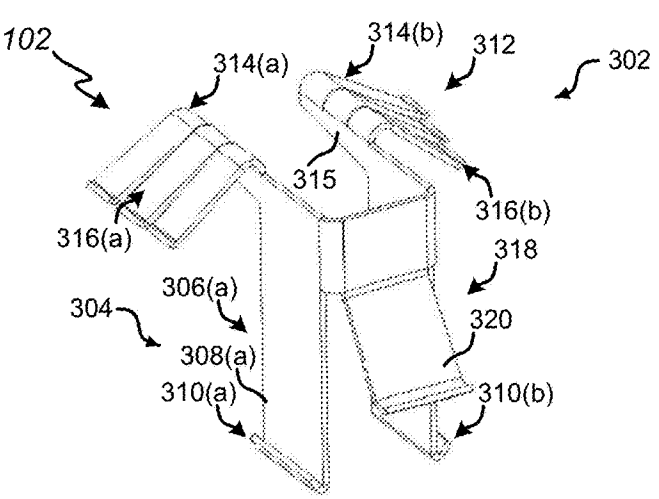
FIG. 3B depicts a perspective view of the drive-through retention device, in accordance with certain embodiments of the present disclosure.
Figure 3D:
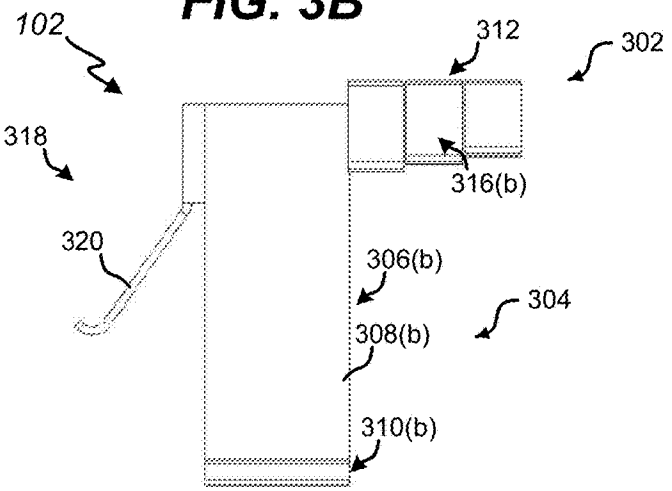
FIG. 3D depicts a tail-facing view of the drive-through retention device, in accordance with certain embodiments of the present disclosure.
Figure 3A:
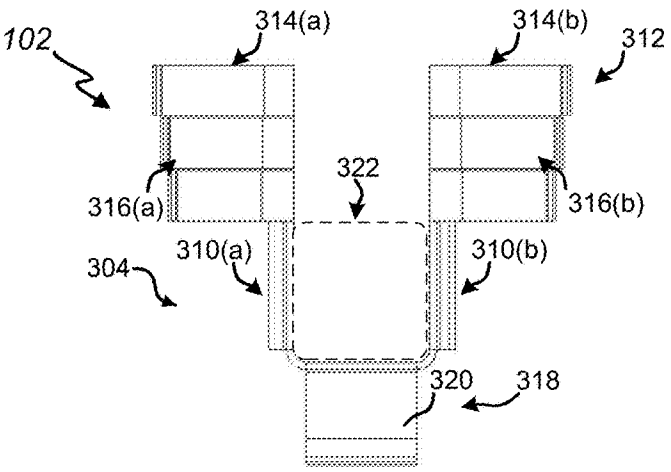
FIG. 3A depicts a top view of a drive-through retention device, in accordance with certain embodiments of the present disclosure.

FIG. 3A depicts a top view of a drive-through retention device 102, in accordance with certain embodiments of the present disclosure. FIG. 3B depicts a perspective view of the drive-through retention device 102, in accordance with certain embodiments of the present disclosure.

Figure 3C:
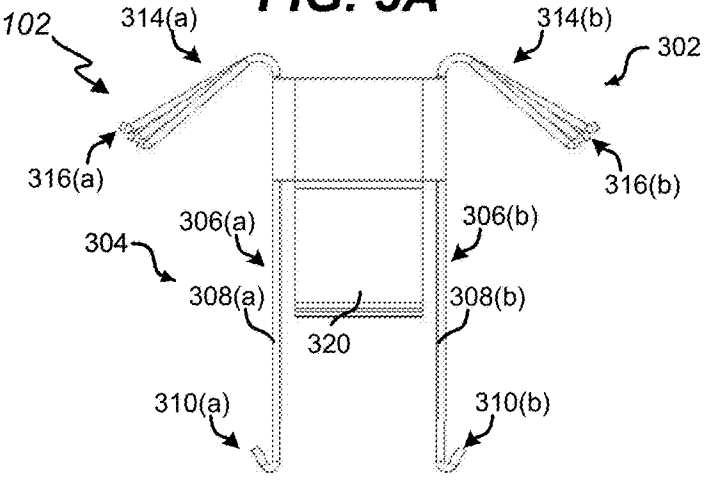
FIG. 3C depicts a rear view of the drive-through retention device, in accordance with certain embodiments of the present disclosure.

FIG. 3C depicts a gage-side view of the drive-through retention device 102, in accordance with certain embodiments of the present disclosure. FIG. 3D depicts a tail-facing view of the drive-through retention device 102, in accordance with certain embodiments of the present disclosure. The drive-through retention device 102 may correspond to the drive-through retention device 102(*a*) and/or the drive-through retention device 102(*b*).

The drive-through retention device 102 may include a head section 302 and an insert section 304. In various embodiments, the head section 302 may be integral with, attached to, and/or otherwise adjacent to the insert section 304. The insert section 304 may be formed to fit in one of the spike holes 118 of the tie plate 114. The insert section 304 may include flexible legs 306(*a*), 306(*b*) extending from the head section 302. The flexible legs 306(*a*), 306(*b*) may be flexible members that correspond to resilient, spring members adapted to allow flex adjustment to flex inwardly toward each other in response to exterior forces being applied to the flexible legs 306(*a*), 306(*b*), (e.g., compression forces) and return to an unflexed state when the forces are removed.

Figure 4:
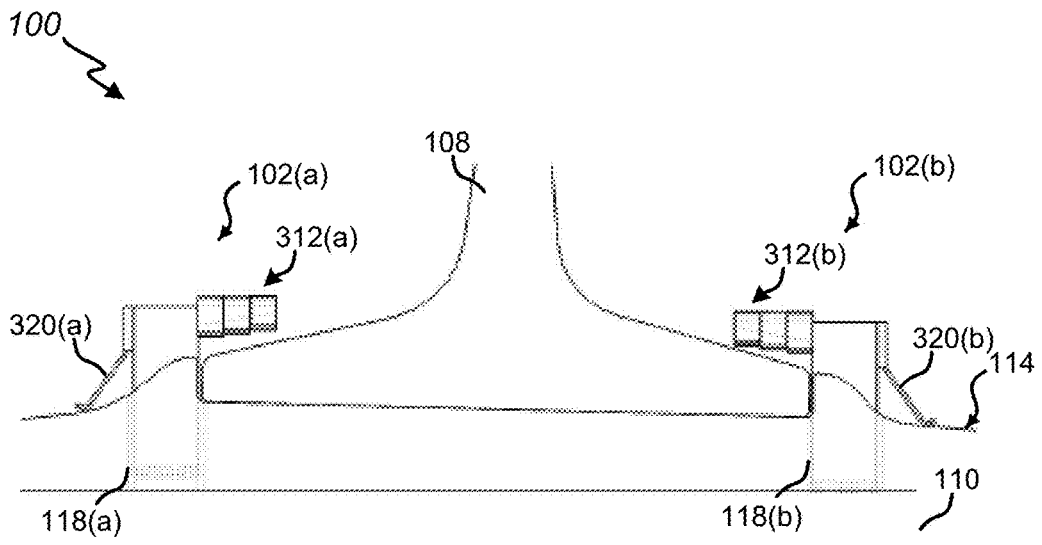
FIG. 4 depicts a partial cross-sectional view of the railway portion with drive-through retention devices illustrated in a process of insertion while the drive-through retention devices are still in an undeflected state, in accordance with certain embodiments of the present disclosure.

For example, when the insert section 304 is inserted in one of the spike holes 118 of the tie plate 114, the flex adjustment may include the flexible legs 306(*a*), 306(*b*) flexing toward each other and, hence, toward a longitudinal axis of the drive-through retention device 102 and/or a longitudinal axis of the spike hole 118. Such an insertion is illustrated by FIG. 4. FIG. 4 depicts a partial cross-sectional view of the railway portion 100 with retention devices 102(*a*), 102(*b*) illustrated in a process of insertion while the retention devices 102(*a*), 102(*b*) are still in an undeflected state, in accordance with certain embodiments of the present disclosure.

Referring again to FIGS. 3A-D, each flexible leg 306(*a*), 306(*b*) may include a respective medial section 308(*a*), 308(*b*) and a respective foot section 310(*a*), 310(*b*). As depicted, the foot sections 310(*a*), 310(*b*) are disposed generally opposite of the head section 302. Each foot section 310(*a*), 310(*b*) may include a lateral protrusion laterally extending with respect to the medial section 308(*a*), 308(*b*) and adapted to engage an underside of the tie plate 114. When the insert section 304 is inserted in one of the spike holes 118 of the tie plate 114 to an extent that the foot sections 310(*a*), 310(*b*) clear the bottom of the spike hole 118, the foot sections 310(*a*), 310(*b*) spring out laterally away from the spike hole 118 as a result of the spring forces of the flexible legs 306(*a*), 306(*b*) and the foot section dimensions and form. The lateral expansion of the foot sections 310(*a*), 310(*b*) may be further facilitated, in various instances, by a gap between the tie plate 114 and the railway tie 110 due to tie contours, tie deterioration, installation tolerances, a spike-pulling process, a rail-lifting process, and/or a special-purpose retention device installation machine.

Figure 5:
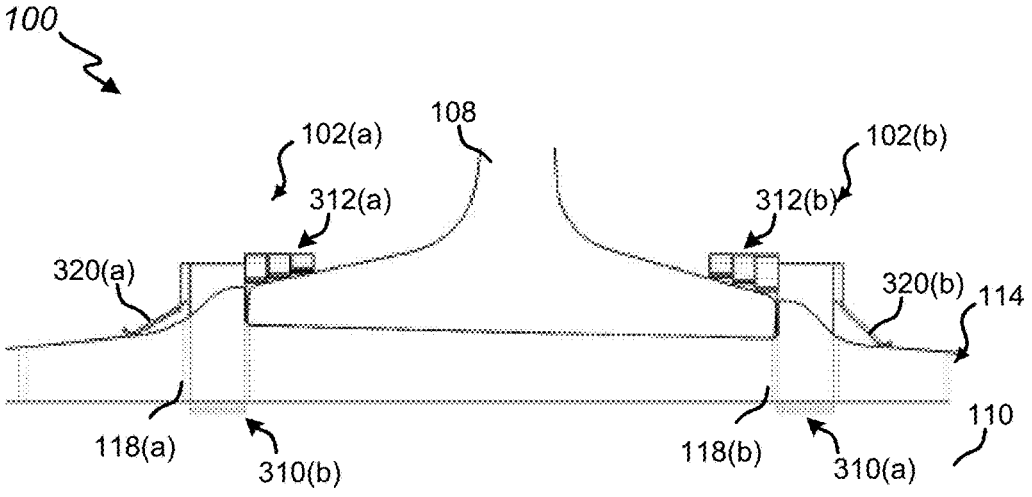
FIG. 5 depicts a partial cross-sectional view of the railway portion with drive-through retention devices illustrated in an installed and deflected state, in accordance with certain embodiments of the present disclosure.

The installed state is illustrated by FIG. 5. FIG. 5 depicts a partial cross-sectional view of the railway portion 100 with retention devices 102(*a*), 102(*b*) illustrated in an installed and deflected state, in accordance with certain embodiments of the present disclosure. The foot sections 310(*a*), 310(*b*) are depicted as below the spike holes 118(*a*), 118(*b*). From those positions, the foot sections 310(*a*), 310(*b*) may engage an underside of the tie plate 114.

Referring again to FIGS. 3A-D, according to some embodiments, the each foot section 310(*a*), 310(*b*) may include a hook formation as is illustrated. However, other embodiments may have other formations including a lateral protrusion to facilitate engagement of an underside of the tie plate 114. Moreover, some embodiments of the foot sections 310(*a*), 310(*b*) may be adapted to deflect to a limited extent while still maintaining a locking engagement of the tie plate 114.

The head section 302 may include one or more protrusions adapted to engage the rail 108. As in the embodiment depicted, the head section 302 may include a nose section 312 and a tail section 318. The nose section 112 may extend from a first side of the head section 302. In some embodiments, the first side of the head section 302 may correspond to a first set of one or more edge(s) and/or plane(s) of the flexible legs 306(*a*), 306(*b*). The tail section 318 may be disposed generally opposite of the nose section 112 and may extend from a second side of the head section 302. In some embodiments, the second side of the head section 302 may correspond to a second set of one or more edge(s) and/or plane(s) of the flexible legs 306(*a*), 306(*b*), which second set may be generally opposite of the first set in some embodiments.

As in the embodiment depicted, the nose section 312 may include wings 314(*a*), 314(*b*). Each of the wings 314(*a*), 314(*b*) may respectively include a support structure 315 extending along a length of the nose section 312. In the orientation depicted, the support structures 315 may have one or more heights and thicknesses to optimize structural rigidity and strength to provide support for fins 316(*a*), 316(*b*). The heights and thicknesses of the wings 314(*a*), 314(*b*) as a whole may impart advantageous stress carrying capacity to the nose section 312.

The fins 316(*a*), 316(*b*) may be flexible members corresponding to resilient, spring-like extensions which allow for flex adjustments to bend upward and/or at upward angle when engaging a base of the rail 108 and under load. The fins 316(*a*), 316(*b*) may each include a plurality of individual fins 316(*a*), 316(*b*) adapted to spring and deflect as needed to facilitate a best possible fit when pressed into an application by deflecting into a position where the fit is sufficiently tight and accommodates both the tall side of the tie plate 114 and the short side of the tie plate 114. In the undeflected state shown, the individual fins 316(*a*), 316(*b*) may be staggered at different angles. The different angles may facilitate adaption to the different heights and angles of the rail 108. The ends of the individual fins 316(*a*), 316(*b*) may be curved upward, as depicted, to facilitate sliding adjustment when the individual fins 316(*a*), 316(*b*) engage the base of the rail 108. As in the embodiment depicted, the fins 316(*a*), 316(*b*) may each include three individual fins 316(*a*), 316(*b*). However, in various embodiments, the fins 316(*a*), 316(*b*) may each correspond to a single fin or may include two, four, or any suitable number of individual fins.

The tail section 318 may extend from the second side of the head section 302 that may correspond to the second set of one or more edge(s) and/or plane(s) of the flexible legs 306(*a*), 306(*b*). The tail section 318 may include a tail 320 corresponding to a flexible member that is a resilient, spring-like extension which allows for flex adjustments to provide a spring force. The tail 320 may extend at any suitable angle in various embodiments. The end of the tail 320 may be curved upward, as depicted, to facilitate sliding adjustment when the tail 320 engages a top surface of the tie plate 114. In some embodiments, the tail 320 and the nose section 312 may be adapted to simultaneously engage or substantially simultaneously engage a top surface of the tie plate 114 and a base of the rail 108, respectively. For example, as depicted in FIG. 4, nose section 312(*b*) and tail 320(*b*) of the gage-side drive-through retention device 102 (*b*) contact the rail 108 and the tie plate 114 simultaneously or substantially simultaneously. Tail 320(*a*) of the field-side drive-through retention device 102(*a*) is depicted as contacting the tie plate 114 before nose section 312(*a*) contacts the rail 108.

Referring again to FIGS. 3A-D, in some embodiments, an additional function of the tail section 318 may be that the rear tail 320 stabilizes the drive-through retention device 102 when the drive-through retention device 102 is installed and/or in the process of being installed in the spike hole 118 by providing a rear stabilizing effect. The rear stabilizing effect may balance the drive-through retention device 102 as the nose section 312 engage a surface of the rail 108. When the nose section 312 engages a surface of the rail 108, the retention device may tend to tilt backwards away from the rail 108. In some embodiments, the tail 320 may be adapted to simultaneously engage a top surface of the tie plate 114 to maintain the drive-through retention device 102 in a vertical or substantially vertical orientation when inserting the flexible legs 306(*a*), 306(*b*) of the insert section 304 into the spike hole 118 in order for the flexible legs 306(*a*), 306(*b*) to extend sufficiently deep within the spike hole 118 for the foot sections 310(*a*), 310(*b*) to spring out of the bottom of the spike hole 118.

Figure 6:
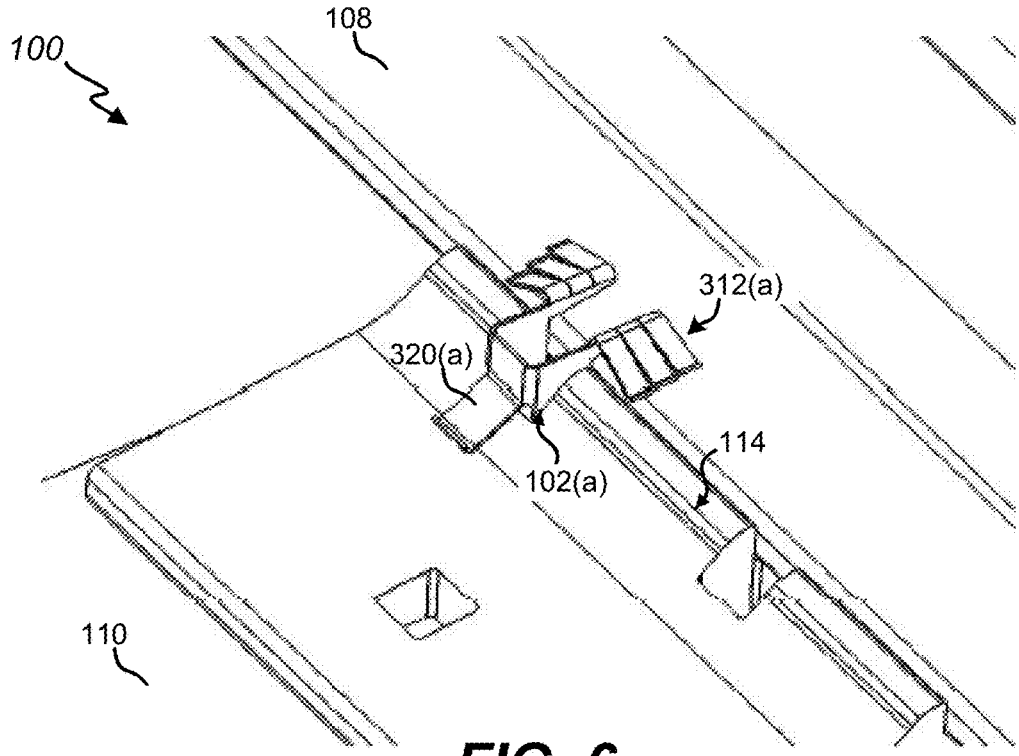
FIG. 6 depicts a partial perspective view of the railway portion with the drive-through retention device illustrated in the installed and deflected state, in accordance with certain embodiments of the present disclosure.
Figure 7:
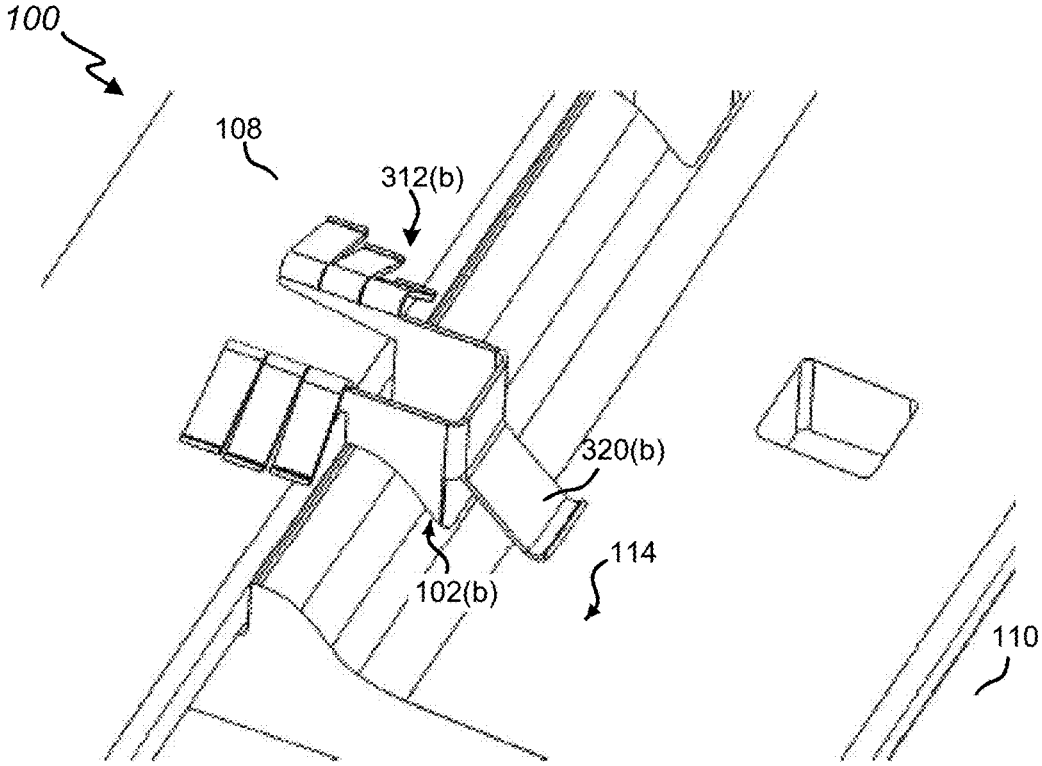
FIG. 7 depicts a partial perspective view of the railway portion with the drive-through retention device illustrated in the installed and deflected state, in accordance with certain embodiments of the present disclosure.

When the foot sections 310(*a*), 310(*b*) spring out of the bottom of the spike hole 118, the points of contact effected by the foot sections 310(*a*), 310(*b*), the wings 314(*a*), 314(*b*), and the tail 320 may seat the drive-through retention device 102 with a tight, secure mechanical fit that interlocks the tie plate 114 and the rail 108. Each wing 314(*a*), 314(*b*) may provide multiple points of contact corresponding to the multiple fins 316(*a*), 316(*b*) engaging the rail 108. This is illustrated by FIGS. 5, 6, and 7. FIG. 6 depicts a partial perspective view of the railway portion 100 with the drive-through retention device 102(*a*) illustrated in the installed and deflected state, in accordance with certain embodiments of the present disclosure. FIG. 7 depicts a partial perspective view of the railway portion 100 with the drive-through retention device 102(*b*) illustrated in the installed and deflected state, in accordance with certain embodiments of the present disclosure.

As depicted, the retention devices 102(*a*), 102(*b*) have deflected into locked positions. Specifically, the nose section 312(*b*) and the tail 320(*b*) of the gage-side drive-through retention device 102(*b*) are depicted as having deflected into one locked position. By comparison, the nose section 312(*a*) and the tail 320(*a*) of the field-side drive-through retention device 102(*a*) are depicted as having deflected into another locked position. The extent of deflection of the field-side drive-through retention device 102(*a*) is greater than the extent of deflection of gage-side drive-through retention device 102(*b*) due to the adaption to the different heights and angles of the rail 108 and the tie plate 114. Accordingly, certain embodiments may provide for adaptability when the retention devices are pushed into a deflected, locked position to accommodate variances in tolerances, dimensions, and styles of rail sections, spike holes, tie plates, and relative positions thereof. Thus, certain embodiments are self-adjusting so that one retention device fits all or many applications.

Referring again to FIGS. 3A-D, the drive-through retention device 102 may be configured to be a drive-through retention device that allows railway spikes to be driven through the drive-through retention device 102 and the spike hole 118 in which the drive-through retention device 102 is installed. As depicted, the head section 302 and the insert section 304 may be formed, in some embodiments, to at least partially define an internal bore 322 adapted to allow a railway spike to pass through the internal bore 322 and the spike hole 118 of the railway tie plate 114 when the head section 302 and the insert section 304 is inserted in the spike hole 118 of railway tie plate 114. The wings 314(*a*), 314(*b*) are oriented away from the internal bore 322 in order to accommodate a spike body and a spike head so as not to interfere with the railway spike in any way as the railway spike is driven downwards through the internal bore 322 and the spike hole 118, and into the railway tie 110 so that the railway spike engages the rail 108. Accordingly, the drive-through retention device 102 may be a permanent fastener to retain the tie plate 114 against the rail 108 before, during, and after a railway tie removal and replacement process. While the drive-through retention device 102 could be removed after a new railway tie is placed into final position, the drive-through retention device 102 need not be removed.

Figure 8:
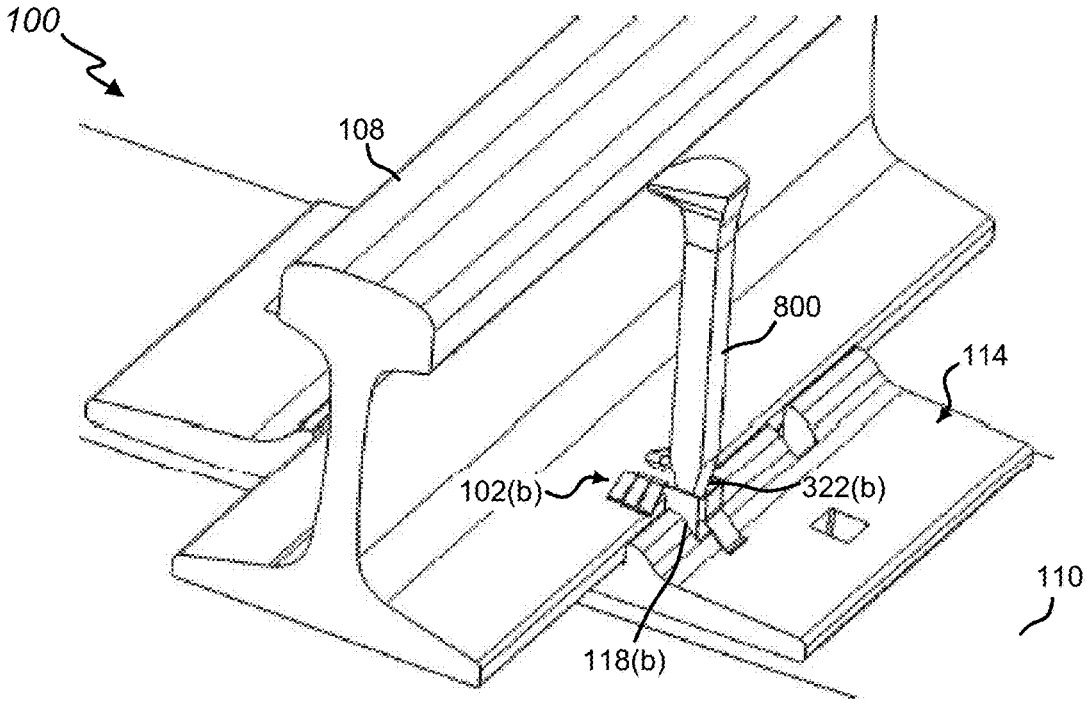
FIG. 8 depicts a partial perspective view of the railway portion with a railway spike in the process of being inserted into the spike hole and an internal bore partially defined by the drive-through retention device, in accordance with certain embodiments of the present disclosure.
Figure 9:
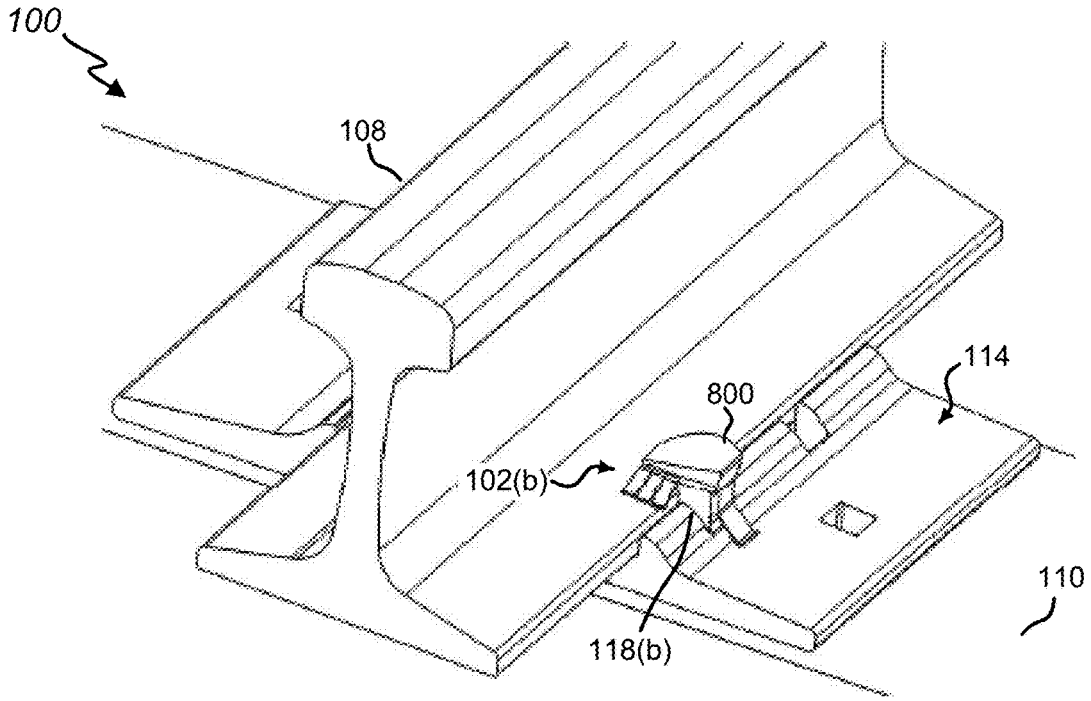
FIG. 9 depicts a partial perspective view of the railway portion with the railway spike installed in the spike hole and the internal bore partially defined by the drive-through retention device, in accordance with certain embodiments of the present disclosure.

FIG. 8 depicts a partial perspective view of the railway portion 100 with a railway spike 800 in the process of being inserted into the spike hole 118(*b*) and an internal bore 322(*b*) partially defined by the drive-through retention device 102(*b*), in accordance with certain embodiments of the present disclosure. For the sake of clarity, the railway spike 800 is illustrated as suspended in its position without the typical spike-driving equipment. FIG. 9 depicts a partial perspective view of the railway portion 100 with the railway spike 800 installed in the spike hole 118(*b*) and the internal bore 322(*b*) partially defined by the drive-through retention device 102(*b*), in accordance with certain embodiments of the present disclosure.

The drive-through retention device 102 may be configured such that, when the railway spike 800 is later removed with a conventional spike puller, both the railway spike 800 and the drive-through retention device 102 are removed simultaneously as part of the conventional spike pulling process. The wings 314(*a*), 314(*b*) of the drive-through retention device 102 may be configured such that the wings 314(*a*), 314(*b*) catch the spike-pulling tool when the tool sweeps down to engage the spike head. When engaged by the spike-pulling tool, the wings 314(*a*), 314(*b*) may rotate upwards toward the spike head. As the spike-pulling tool retracts in an upward direction, the wings 314(*a*), 314(*b*) may bind together with the spike head so that the spike-pulling tool pulls the drive-through retention device 102 and the railway spike 800 together. After that point, another drive-through retention device 102 could be installed in the same spike hole 118(*b*). In some cases, another drive-through retention device 102 could be installed in a different spike 118, prior to and/or after removal of the drive-through retention device 102 and the railway spike 800.

Figure 10B:
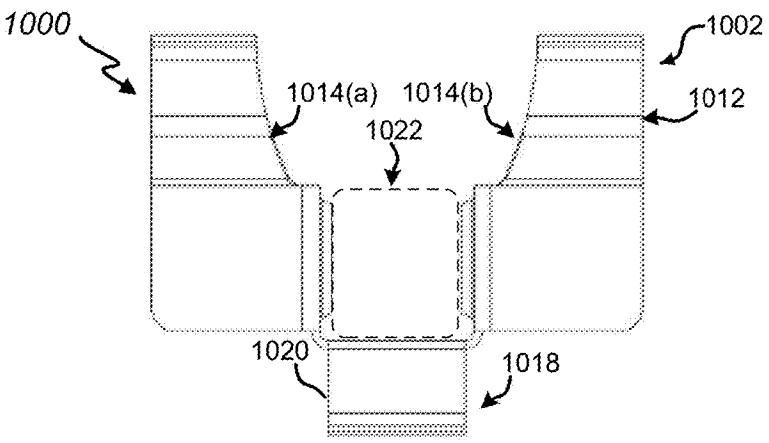
FIG. 10B depicts a top view of the drive-through retention device, in accordance with certain embodiments of the present disclosure.
Figure 10A:
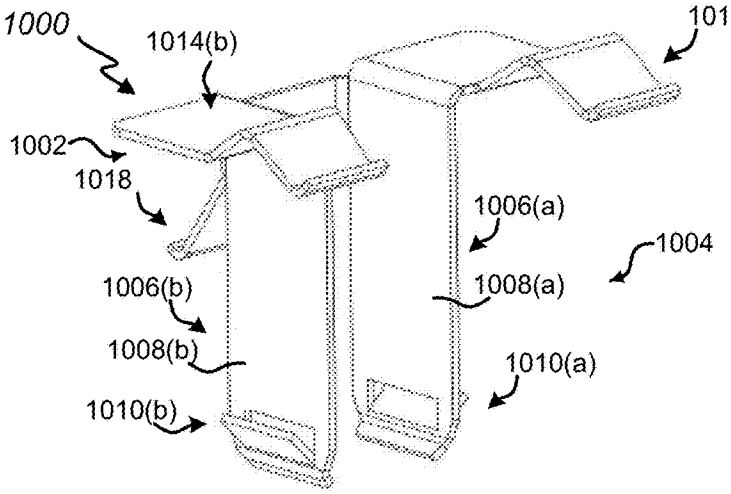
FIG. 10A depicts a perspective view of a drive-through retention device, in accordance with certain embodiments of the present disclosure.
Figure 10D:
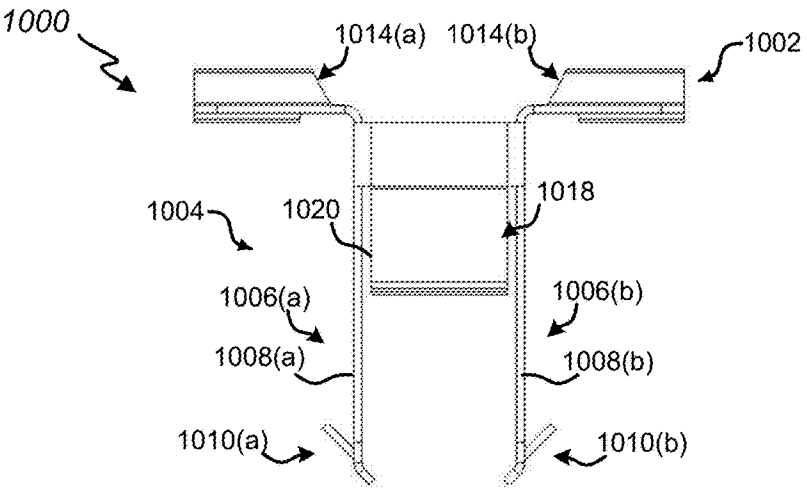
FIG. 10D depicts a tail-facing view of the drive-through retention device, in accordance with certain embodiments of the present disclosure.
Figure 10C:
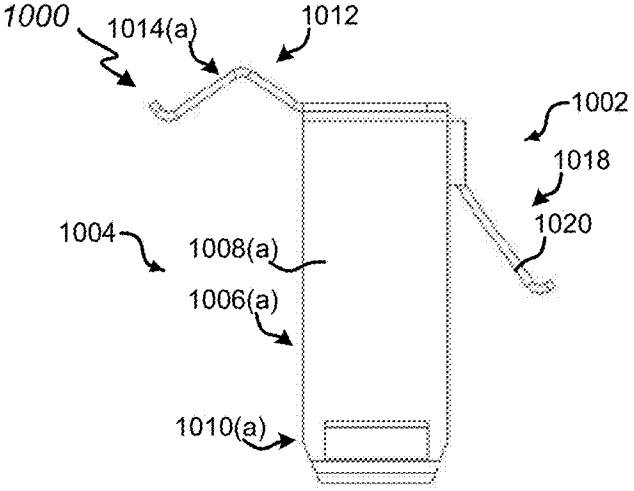
FIG. 10C depicts a side view of the drive-through retention device, in accordance with certain embodiments of the present disclosure.

Other embodiments of drive-through retention devices are possible. For example, FIG. 10A depicts a perspective view of a drive-through retention device 1000, in accordance with certain embodiments of the present disclosure. FIG. 10B depicts a top view of the drive-through retention device 1000, in accordance with certain embodiments of the present disclosure. FIG. 10C depicts a side view of the drive-through retention device 1000, in accordance with certain embodiments of the present disclosure. FIG. 10D depicts a tail-facing view of the drive-through retention device 1000, in accordance with certain embodiments of the present disclosure. The drive-through retention device 1000 may be similar to the drive-through retention device 102 in function and design.

The drive-through retention device 1000 may include a head section 1002 and an insert section 1004. In various embodiments, the head section 1002 may be integral with, attached to, and/or otherwise adjacent to the insert section 1004. The insert section 1004 may be formed to fit in one of the spike holes 118 of the tie plate 114. The insert section 1004 may include flexible legs 1006(*a*), 1006(*b*) extending from the head section 1002. The flexible legs 1006(*a*), 1006(*b*) may be flexible members that correspond to resilient, spring members adapted to allow flex adjustment similar to the flexible legs 306(*a*), 306(*b*) of the drive-through retention device 102.

Each flexible leg 1006(*a*), 1006(*b*) may include a respective medial section 1008(*a*), 1008(*b*) and a respective foot section 1010(*a*), 1010(*b*). As depicted, the foot sections 1010(*a*), 1010(*b*) are disposed generally opposite of the head section 1002. Each foot section 1010(*a*), 1010(*b*) may include a lateral protrusion laterally extending with respect to the medial section 1008(*a*), 1008(*b*) and adapted to engage an underside of the tie plate 114. Similar to the drive-through retention device 102, when the insert section 1004 is inserted in one of the spike holes 118 of the tie plate 114 to an extent that the foot sections 1010(*a*), 1010(*b*) clear the bottom of the spike hole 118, the foot sections 1010(*a*), 1010(*b*) spring out laterally away from the spike hole 118 as a result of the spring forces of the flexible legs 1006(*a*), 1006(*b*) and the foot section dimensions and form.

Figure 11:
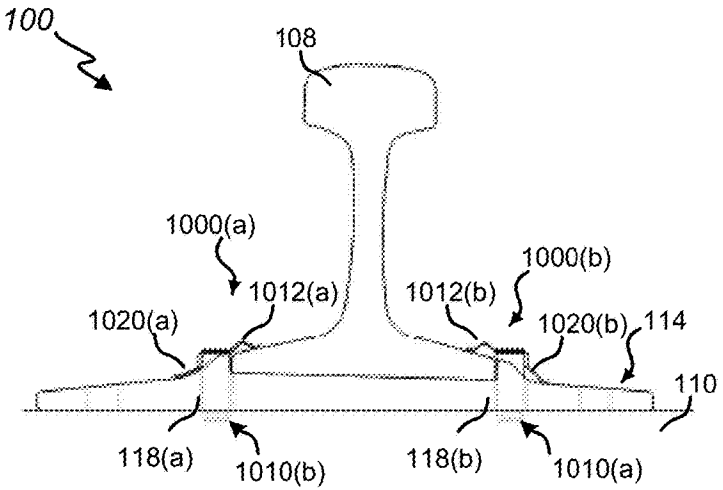
FIG. 11 depicts a partial cross-sectional view of the railway portion with drive-through retention devices illustrated in an installed and deflected state, in accordance with certain embodiments of the present disclosure.

The installed state is illustrated by FIG. 11. FIG. 11 depicts a partial cross-sectional view of the railway portion 100 with retention devices 1000(*a*), 1000(*b*) illustrated in an installed and deflected state, in accordance with certain embodiments of the present disclosure. The foot sections 1010(*a*), 1010(*b*) are depicted as below the spike holes 118(*a*), 118(*b*). From those positions, the foot sections 1010(*a*), 1010(*b*) may engage an underside of the tie plate 114.

Referring again to FIGS. 10A-D, according to some embodiments, the each foot section 1010(*a*), 1010(*b*) may include a dual-wing formation as is illustrated. The lower portions of the dual-wing formations may angle downward and inward toward each other. With some embodiments, the angled lower portions may facilitate entry of the flexible legs 1006(*a*), 1006(*b*) into the spike hole 118 by slidingly engaging opposing edges of the spike hole 118, centering the retention device 1002 between the opposing edges, and facilitating compression of the flexible legs 1006(*a*), 1006(*b*) by way of the sliding engagement. The higher portions of the dual-wing formations may angle upward and away from each other. The angled lower portions may facilitate engagement with the underside of the tie plate 114. However, other embodiments may have other formations including a lateral protrusion to facilitate engagement of an underside of the tie plate 114. Moreover, some embodiments of the foot sections 1010(*a*), 1010(*b*) may be adapted to deflect to a limited extent while still maintaining a locking engagement of the tie plate 114.

The head section 1002 may include one or more protrusions adapted to engage the rail 108. As in the embodiment depicted, the head section 1002 may include a nose section 1012 and a tail section 1018 extending respectively from a first side of the head section 1002 and a second side of the head section 1002, similar to the drive-through retention device 102. As in the embodiment depicted, the nose section 1012 may include arms 1014(*a*), 1014(*b*) that may extend laterally and forward. The arms 1014(*a*), 1014(*b*) may be flexible members corresponding to resilient, spring-like extensions to allow for flex adjustments to bend upwards, backwards, and/or at upward and/or backward angles when engaging a base of the rail 108 and under load. The arms 1014(*a*), 1014(*b*) may be adapted to spring and deflect as needed to facilitate a best possible fit when pressed into an application by deflecting into a position where the fit is sufficiently tight and accommodates both the tall side of the tie plate 114 and the short side of the tie plate 114. The different angles of the arms 1014(*a*), 1014(*b*) may facilitate adaption to the different heights and angles of the rail 108. The ends of the arms 1014(*a*), 1014(*b*) may be curved upward, as depicted, to facilitate sliding adjustment when the arms 1014(*a*), 1014(*b*) engage the base of the rail 108.

The tail section 1018 may include a tail 1020 and may be similar in function and form to the tail section 318 and tail 320 of the drive-through retention device 102. In some embodiments, the tail 1020 and the nose section 1012 may be adapted to simultaneously engage or substantially simultaneously engage a top surface of the tie plate 114 and a base of the rail 108, respectively. In some embodiments, the tail section 1018 may stabilize the drive-through retention device 1000 when the drive-through retention device 1000 is installed and/or in the process of being installed in the spike hole 118 by providing a rear stabilizing effect. The rear stabilizing effect may balance the drive-through retention device 1000 as the nose section 1012 engage a surface of the rail 108. When the nose section 1012 engages a surface of the rail 108, the retention device may tend to tilt backwards away from the rail 108. In some embodiments, the tail 1020 may be adapted to simultaneously engage a top surface of the tie plate 114 to maintain the drive-through retention device 1000 in a vertical or substantially vertical orientation when inserting the flexible legs 1006(*a*), 1006(*b*) of the insert section 1004 into the spike hole 118 in order for the flexible legs 1006(*a*), 1006(*b*) to extend sufficiently deep within the spike hole 118 for the foot sections 1010(*a*), 1010(*b*) to spring out of the bottom of the spike hole 118.

When the foot sections 1010(*a*), 1010(*b*) spring out of the bottom of the spike hole 118, the points of contact effected by the foot sections 1010(*a*), 1010(*b*), the arms 1014(*a*), 1014(*b*), and the tail 1020 may seat the drive-through retention device 1000 with a tight, secure mechanical fit that interlocks the tie plate 114 and the rail 108. This is illustrated by FIG. 11. As depicted, the retention devices 1000(*a*), 1000(*b*) have deflected into locked positions.

Specifically, the nose section 1012(*b*) and the tail 1020(*b*) of the gage-side drive-through retention device 1000(*b*) are depicted as having deflected into one locked position. By comparison, the nose section 1012(*a*) and the tail 1020(*a*) of the field-side drive-through retention device 1000(*a*) are depicted as having deflected into another locked position. The extent of deflection of the field-side drive-through retention device 1000(*a*) is greater than the extent of deflection of gage-side drive-through retention device 1000(*b*) due to the adaption to the different heights and angles of the rail 108 and the tie plate 114.

Referring again to FIGS. 10A-D, the drive-through retention device 1000 may be configured to be a drive-through retention device that allows railway spikes to be driven through the drive-through retention device 1000 and the spike hole 118 in which the drive-through retention device 1000 is installed. As depicted, the head section 1002 and the insert section 1004 may be formed, in some embodiments, to at least partially define an internal bore 1022 adapted to allow a railway spike to pass through the internal bore 1022 and the spike hole 118 of the railway tie plate 114 when the head section 1002 and the insert section 1004 is inserted in the spike hole 118 of railway tie plate 114. The arms 1014(*a*), 1014(*b*) are oriented away from the internal bore 1022 in order to accommodate a spike body and a spike head so as not to interfere with the railway spike in any way as the railway spike is driven downwards through the internal bore 1022 and the spike hole 118, and into the railway tie 110 so that the railway spike engages the rail 108.

Figure 12:
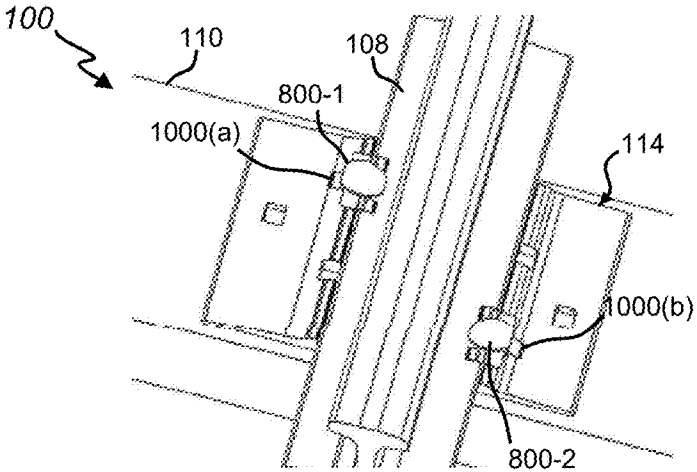
FIG. 12 depicts a partial perspective view of the railway portion with railway spikes installed in the spike holes and the internal bores partially defined by the drive-through retention devices, in accordance with certain embodiments of the present disclosure.
Figure 13B:
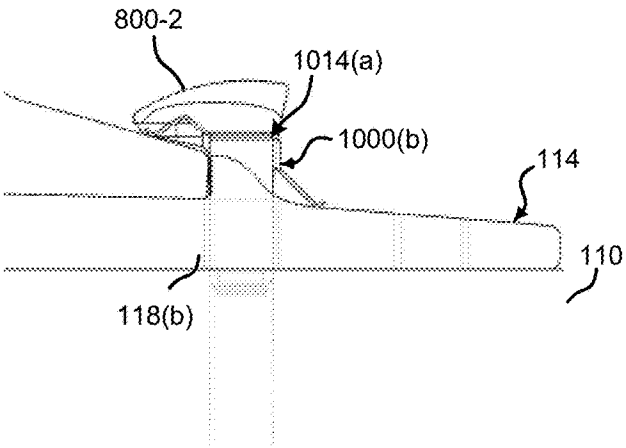
FIG. 13B depicts a partial side view of the railway portion with the railway spike installed in the spike hole and the internal bore partially defined by the drive-through retention device, in accordance with certain embodiments of the present disclosure.
Figure 13A:
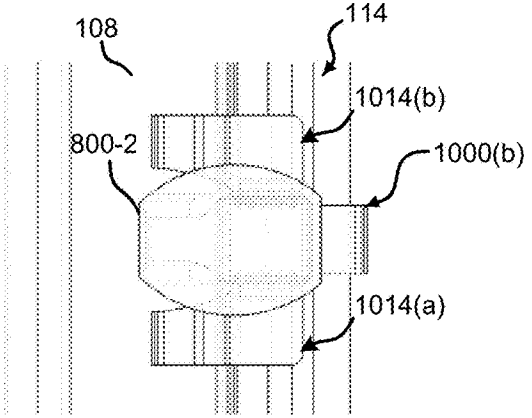
FIG. 13A depicts a partial top view of the railway portion with the railway spike installed in the spike hole and the internal bore partially defined by the drive-through retention device, in accordance with certain embodiments of the present disclosure.

FIG. 12 depicts a partial perspective view of the railway portion 100 with railway spikes 800 installed in the spike holes 118(*a*), 118(*b*) and the internal bores partially defined by the retention devices 1000(*a*), 1000(*b*), in accordance with certain embodiments of the present disclosure. FIG. 13A depicts a partial top view of the railway portion 100 with the railway spike 800-2 installed in the spike hole 118(*b*) and the internal bore partially defined by the drive-through retention device 1000(*b*), in accordance with certain embodiments of the present disclosure. FIG. 13B depicts a partial side view of the railway portion 100 with the railway spike 800-2 installed in the spike hole 118(*b*) and the internal bore partially defined by the drive-through retention device 1000(*b*), in accordance with certain embodiments of the present disclosure.

Similar to the drive-through retention device 102, the drive-through retention device 1000 may be configured such that, when the railway spike 800 is later removed with a conventional spike puller, both the railway spike 800 and the drive-through retention device 1000 are removed simultaneously as part of the conventional spike pulling process. The arms 1014(*a*), 1014(*b*) of the drive-through retention device 1000 may be configured such that the arms 1014(*a*), 1014(*b*) catch the spike-pulling tool when the tool sweeps down to engage the spike head. When engaged by the spike-pulling tool, the arms 1014(*a*), 1014(*b*) may rotate upwards toward the spike head. As the spike-pulling tool retracts in an upward direction, the arms 1014(*a*), 1014(*b*) may bind together with the spike head so that the spike-pulling tool pulls the drive-through retention device 1000 and the railway spike 800 together.

Other embodiments are possible. In some embodiments, one or more feet of a retention device may have different orientations than the embodiments depicted. For example, some embodiments may have a pair of feet that oriented such that one foot extends from the bottom of the spike hole to the field side, and another foot extends from the bottom of the spike hole toward the gage side. Such an embodiment may result in four legs sharing the load, thereby increasing the strength of the support.

Figure 14B:
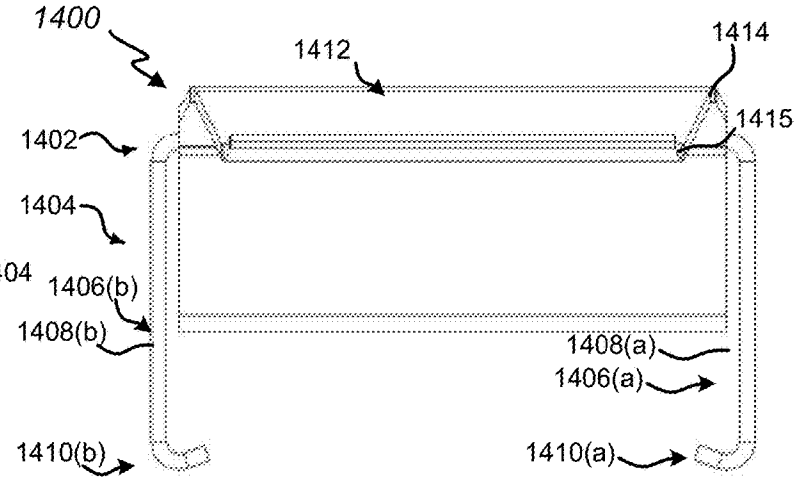
FIG. 14B depicts a nose-facing view of the spanner retention device, in accordance with certain embodiments of the present disclosure.
Figure 14D:
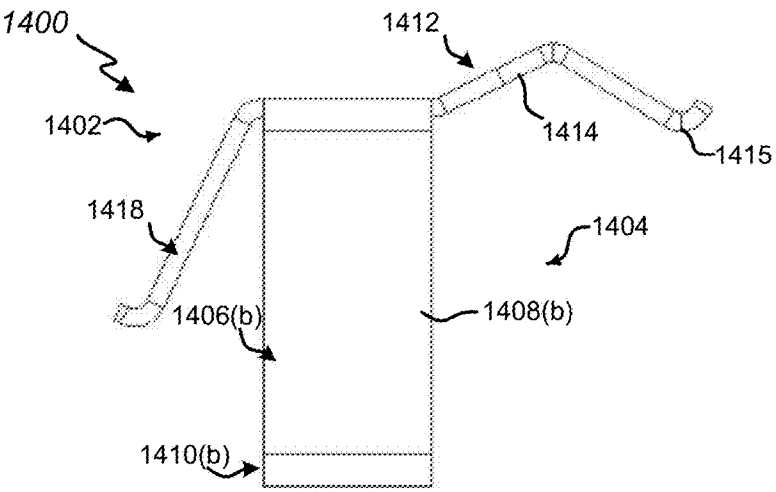
FIG. 14D depicts a side view of the spanner retention device, in accordance with certain embodiments of the present disclosure.
Figure 14A:
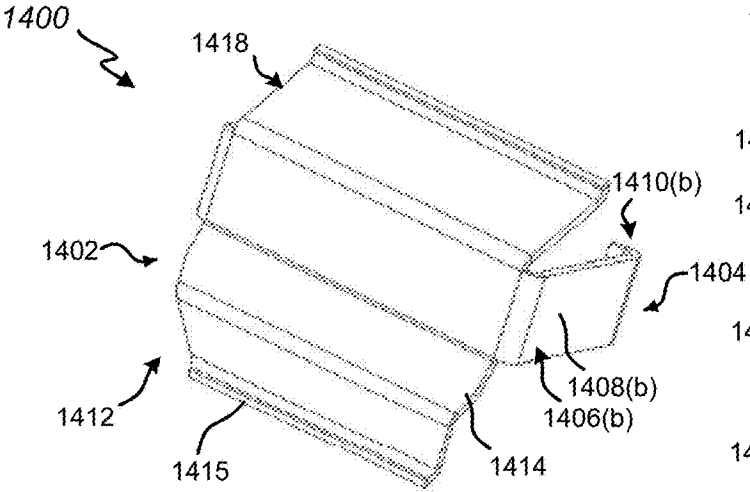
FIG. 14A depicts a top perspective view of a spanner retention device, in accordance with certain embodiments of the present disclosure.
Figure 14C:
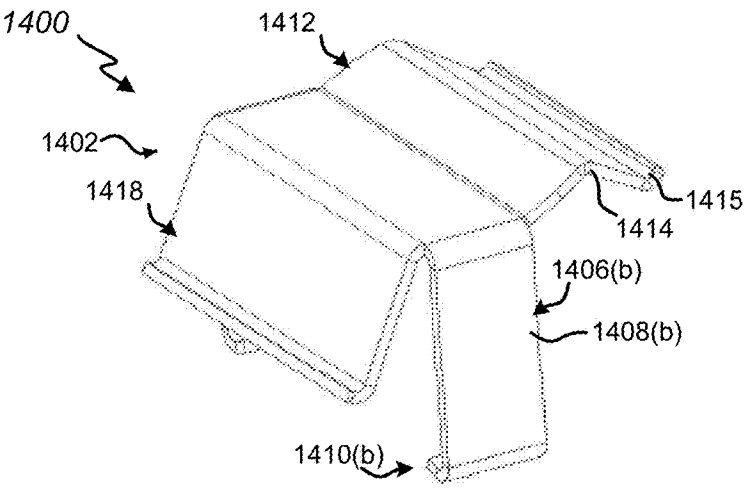
FIG. 14C depicts another perspective view of the retention device, in accordance with certain embodiments of the present disclosure.

Still other embodiments of retention devices are possible. For example, FIG. 14A depicts a top perspective view of a spanner retention device 1400, in accordance with certain embodiments of the present disclosure. FIG. 14B depicts a nose-facing view of the spanner retention device 1400, in accordance with certain embodiments of the present disclosure. FIG. 14C depicts another perspective view of the retention device 1400, in accordance with certain embodiments of the present disclosure. FIG. 14D depicts a side view of the spanner retention device 1400, in accordance with certain embodiments of the present disclosure.

Figure 15:
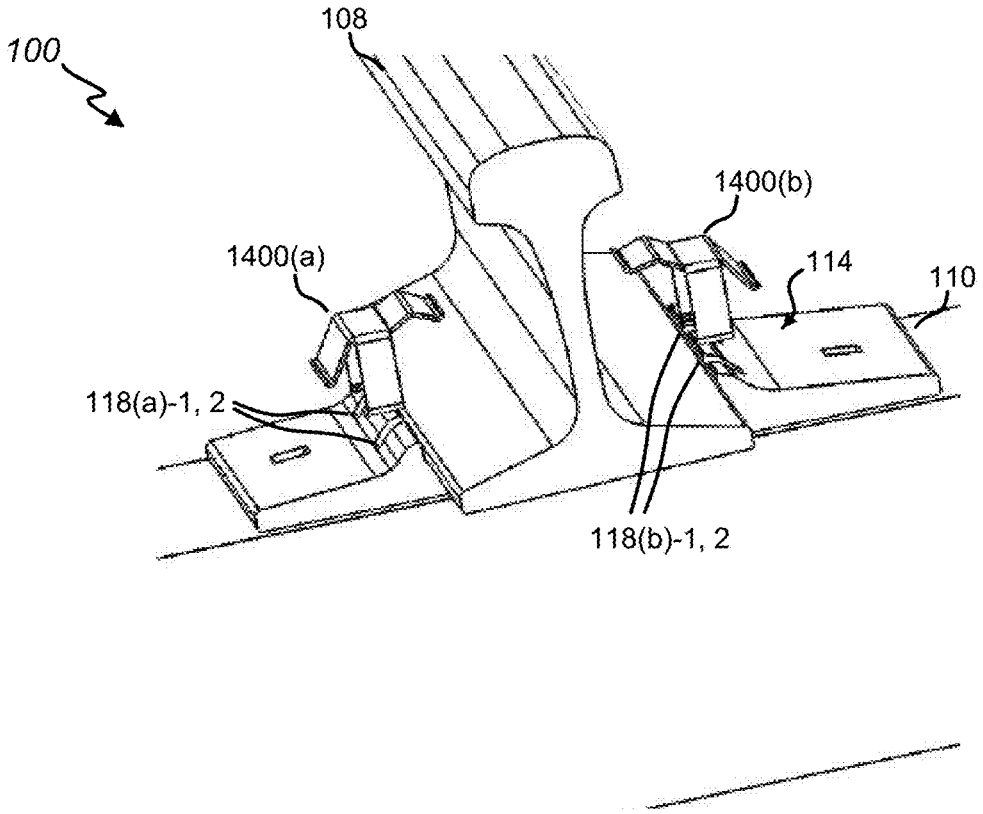
FIG. 15 depicts the perspective view of the railway portion with spanner retention devices illustrated in relation to the railway portion, in accordance with certain embodiments of the present disclosure.

The spanner retention device 1400 may be similar to the drive-through retention device 1000 in function and design. However, the spanner retention device 1400 may be adapted to span two spike holes 118. And, rather than being a drive-through retention device that allows a railway spike to pass through the device, the spanner retention device 1400 may be a drive-by retention device that allows one or more railway spikes to be driven alongside the spanner retention device 1400 into one or both spike holes when the spanner retention device 1400 is installed in the spike holes. FIG. 15 depicts the perspective view of the railway portion 100 with retention devices 1400(*a*), 1400(*b*) illustrated in relation to the railway portion 100, in accordance with certain embodiments of the present disclosure. For the sake of explanation, the spanner retention devices 1400(*a*), 1400(*b*) are illustrated as suspended above corresponding spike holes pairs 118(*a*), 118(*b*).

Referring again to FIGS. 14A-D, the spanner retention device 1400 may include a head section 1402 and an insert section 1404. In various embodiments, the head section 1402 may be integral with, attached to, and/or otherwise adjacent to the insert section 1404. The insert section 1404 may be formed to fit in two of the spike holes 118 of the tie plate 114. The insert section 1404 may include flexible legs 1406(*a*), 1406(*b*) extending from the head section 1402. The flexible legs 1406(*a*), 1406(*b*) may be flexible members that correspond to resilient, spring members adapted to allow flex adjustment to flex outwardly away from each other in response to interior forces being applied to the flexible legs 1406(*a*), 1406(*b*), (e.g., expansion forces) and return to an unflexed state when the forces are removed. For example, when the insert section 1404 is inserted in two spike holes 118 of the tie plate 114, the flex adjustment may include the flexible legs 1406(*a*), 1406(*b*) flexing away from each other and, hence, respectively toward longitudinal axes of the spike holes 118.

Each flexible leg 1406(*a*), 1406(*b*) may include a respective medial section 1408(*a*), 1408(*b*) and a respective foot section 1410(*a*), 1410(*b*). As depicted, the foot sections 1410(*a*), 1410(*b*) are disposed generally opposite of the head section 1402. Each foot section 1410(*a*), 1410(*b*) may include a lateral protrusion laterally extending with respect to the medial section 1408(*a*), 1408(*b*) and adapted to engage an underside of the tie plate 114. When the insert section 1404 is inserted into two spike holes 118 of the tie plate 114 to an extent where the foot sections 1410(*a*), 1410(*b*) clear the bottom of the spike hole 118, the foot sections 1410(*a*), 1410(*b*) spring out laterally away from the spike hole 118 and toward each other as a result of the spring forces of the flexible legs 1406(*a*), 1406(*b*) and the foot section dimensions and form.

Figure 16:
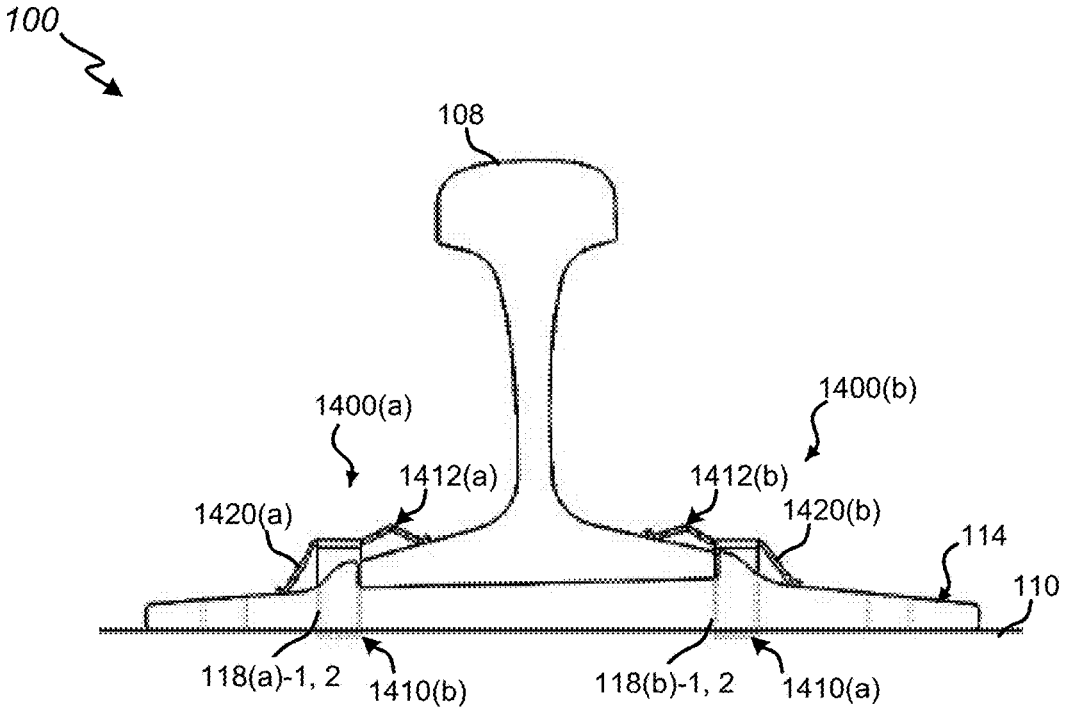
FIG. 16 depicts a partial cross-sectional view of the railway portion with retention devices illustrated in an installed and deflected state, in accordance with certain embodiments of the present disclosure.

The installed state is illustrated by FIG. 16. FIG. 16 depicts a partial cross-sectional view of the railway portion 100 with retention devices 1400(*a*), 1400(*b*) illustrated in an installed and deflected state, in accordance with certain embodiments of the present disclosure. The foot sections 1410(*a*), 1410(*b*) are depicted as below the spike holes 118(*a*), 118(*b*). From those positions, the foot sections 1410(*a*), 1410(*b*) may engage an underside of the tie plate 114.

Referring again to FIGS. 14A-D, according to some embodiments, the each foot section 1410(*a*), 1410(*b*) may include a hook formation as is illustrated similar to that of the drive-through retention device 102. The head section 1402 may include one or more protrusions adapted to engage the rail 148. As in the embodiment depicted, the head section 1402 may include a nose section 1412 and a tail section 1418 extending respectively from a first side of the head section 1402 and a second side of the head section 1402, similar to the retention device 1000. As in the embodiment depicted, the nose section 1412 may include or otherwise correspond to one or more arms that may extend laterally and forward. The depicted embodiment includes a single arm 1414. In some embodiments, the arm 1414 may be divided into any number of fins similar to the drive-through retention device 102. The arm 1414 may be a flexible member corresponding to resilient, spring-like extensions to allow for flex adjustments to bend upwards, backwards, and/or at upward and/or backward angles when engaging a base of the rail 148 and under load. The arm 1414 may be adapted to spring and deflect as needed to facilitate a best possible fit when pressed into an application by deflecting into a position where the fit is sufficiently tight and accommodates both the tall side of the tie plate 114 and the short side of the tie plate 114. The different angles of the arm 1414 may facilitate adaption to the different heights and angles of the rail 148. The end 1415 of the arm 1414 may be curved upward, as depicted, to facilitate sliding adjustment when the arm 1414 engages the base of the rail 148.

The tail section 1418 may include a tail 1420 and may be similar in function and form to the tail section 1018 and tail 1020 of the retention device 1000. In some embodiments, the tail 1420 and the nose section 1412 may be adapted to simultaneously engage or substantially simultaneously engage a top surface of the tie plate 114 and a base of the rail 148, respectively. In some embodiments, the tail section 1418 may stabilize the spanner retention device 1400 when the spanner retention device 1400 is installed and/or in the process of being installed in the spike hole 118 by providing a rear stabilizing effect. The rear stabilizing effect may balance the spanner retention device 1400 as the nose section 1412 engage a surface of the rail 148. In some embodiments, the tail 1420 may be adapted to simultaneously engage a top surface of the tie plate 114 to maintain the spanner retention device 1400 in a vertical or substantially vertical orientation when inserting the flexible legs 1406(*a*), 1406(*b*) of the insert section 1404 into the spike holes 118 in order for the flexible legs 1406(*a*), 1406(*b*) to extend sufficiently deep within the spike holes 118 for the foot sections 1410(*a*), 1410(*b*) to spring out of the bottoms of the spike holes 118.

When the foot sections 1410(*a*), 1410(*b*) spring out of the bottoms of the spike holes 118, the points of contact effected by the foot sections 1410(*a*), 1410(*b*), the arm 1414, and the tail 1420 may seat the spanner retention device 1400 with a tight, secure mechanical fit that interlocks the tie plate 114 and the rail 148. This is illustrated by FIG. 16. As depicted, the spanner retention devices 1400(*a*), 1400(*b*) have deflected into locked positions. Specifically, the nose section 1412(*b*) and the tail 1420(*b*) of the gage-side spanner retention device 1400(*b*) are depicted as having deflected into one locked position. By comparison, the nose section 1412(*a*) and the tail 1420(*a*) of the field-side spanner retention device 1400(*a*) are depicted as having deflected into another locked position. The extent of deflection of the field-side spanner retention device 1400(*a*) is greater than the extent of deflection of gage-side spanner retention device 1400(*b*) due to the adaption to the different heights and angles of the rail 148 and the tie plate 114.

Referring again to FIGS. 14A-D, the spanner retention device 1400 may be configured to be a drive-by retention device that allows one or more railway spikes to be driven alongside the spanner retention device 1400 into one or two spike holes 118 when the spanner retention device 1400 is installed in the spike holes 118. As depicted, the head section 1402 and the insert section 1404 may be dimensioned and formed such that the flexible legs 1406(*a*), 1406(*b*) may tightly fit in a flush manner against sides of the spike holes 118 so as not to interfere with the railway spike in any way as the railway spike is driven downwards through the spike hole 118, and into the railway tie 110 so that the railway spike engages the rail 148. Additionally, the head section 1402 is disposed between the flexible legs 1406(*a*), 1406(*b*) so as not to present interference. This is illustrated by FIG. 17.

Figure 18:
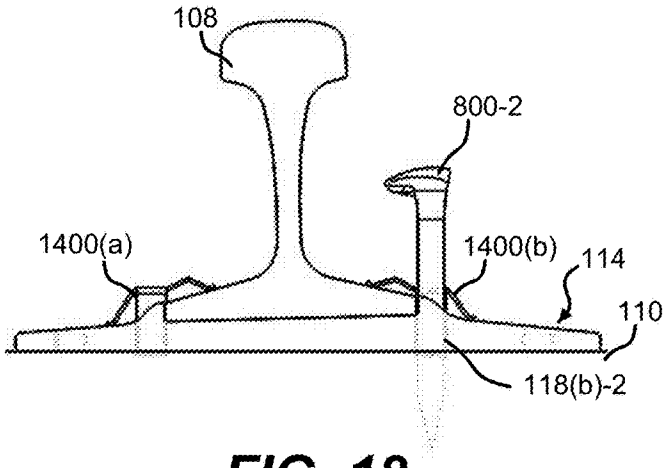
FIG. 18 depicts a side view of the railway portion with a railway spike in the process of being inserted into the spike hole without interference from the spanner retention device, in accordance with certain embodiments of the present disclosure.
Figure 17:
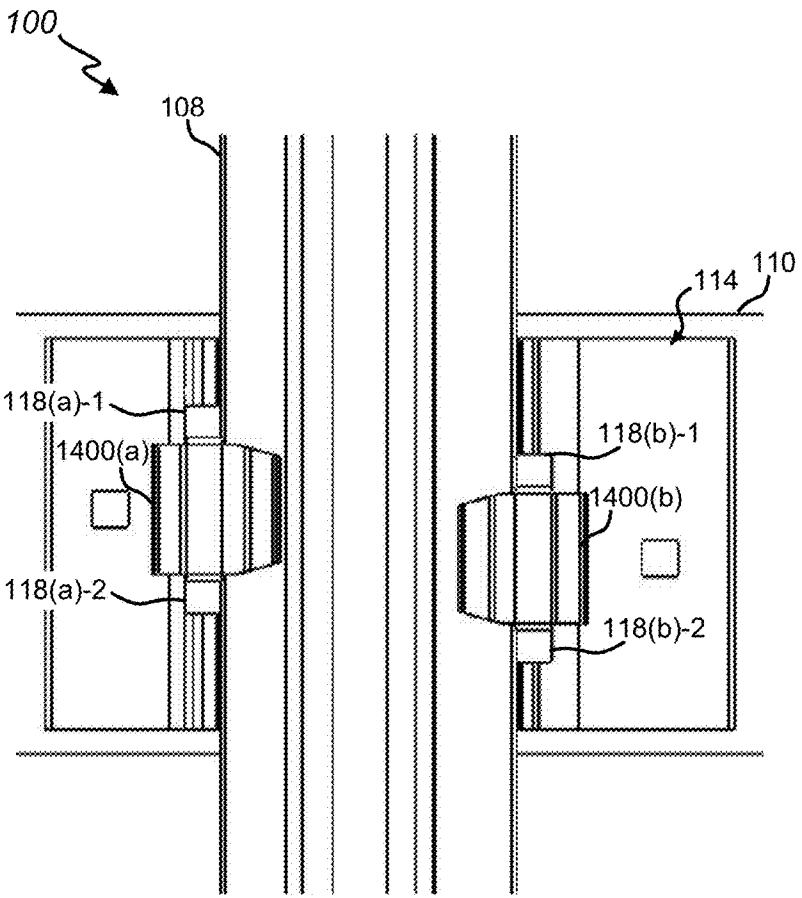
FIG. 17 depicts a top view of the railway portion with the spanner retention devices illustrated in an installed and deflected state, in accordance with certain embodiments of the present disclosure.

FIG. 17 depicts a top view of the railway portion 100 with the spanner retention devices 1400(*a*), 1400(*b*) illustrated in an installed and deflected state, in accordance with certain embodiments of the present disclosure. As illustrated, the spanner retention devices 1400(*a*), 1400(*b*) may be installed with tight fits in the pairs of spike holes 118(*a*), 118(*b*). FIG. 18 depicts a side view of the railway portion 100 with a railway spike 800 in the process of being inserted into the spike hole 118(*b*)-2 without interference from the spanner retention device 1400(*b*), in accordance with certain embodiments of the present disclosure.

Figure 19:
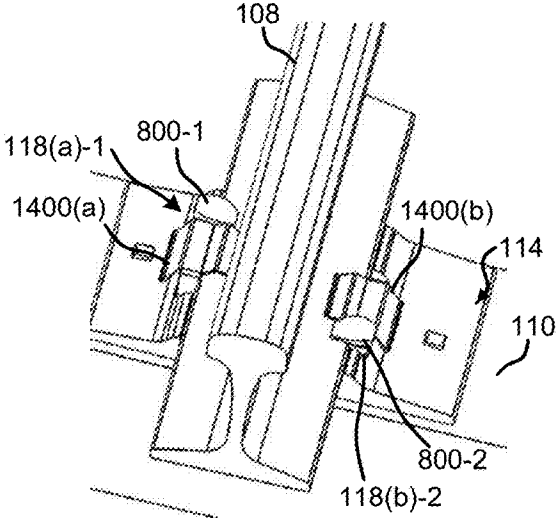
FIG. 19 depicts a partial perspective view of the railway portion with railway spikes installed in the spike holes without interference from the spanner retention devices, in accordance with certain embodiments of the present disclosure.

FIG. 19 depicts a partial perspective view of the railway portion 100 with railway spikes 800 installed in the spike holes 118(*a*)-1, 118(*b*)-2 without interference from the spanner retention devices 1400(*a*), 1400(*b*), in accordance with certain embodiments of the present disclosure. Furthermore, the spanner retention devices 1400(*a*), 1400(*b*) may be configured such that, when the railway spikes 800 are later removed, the tight fit of the spanner retention devices 1400(*a*), 1400(*b*) do not interfere with the spike removal process. Accordingly, the spanner retention devices 1400(*a*), 1400(*b*) may be permanent fasteners to retain the tie plate 114 against the rail 108 before, during, and after railway tie removal and replacement processes, as well as railway spike removal and replacement processes.

Other embodiments are possible. For example, a spanner retention device may be adapted to have a nose section that employs wing and fin features disclosed herein, e.g., with respect to the retention device 102. Similarly, a spanner retention device may be adapted to have a nose section that employs arm features disclosed herein, e.g., with respect to the retention device 1000.

Figure 20A:
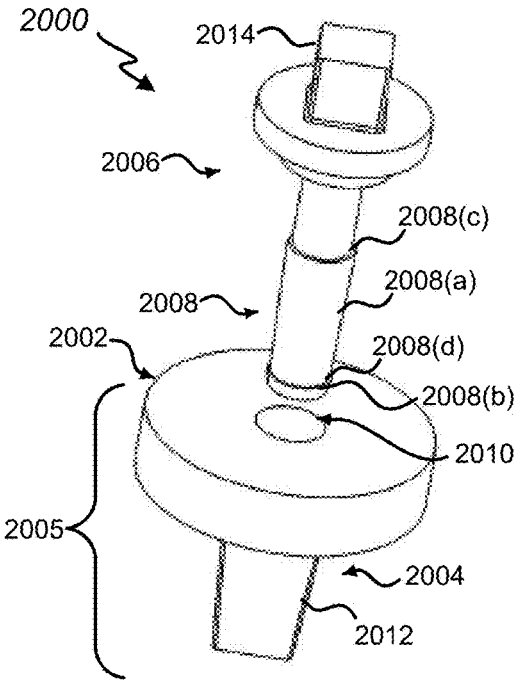
FIG. 20A depicts a perspective view of a composite retention device, in accordance with certain embodiments of the present disclosure.
Figure 20B:
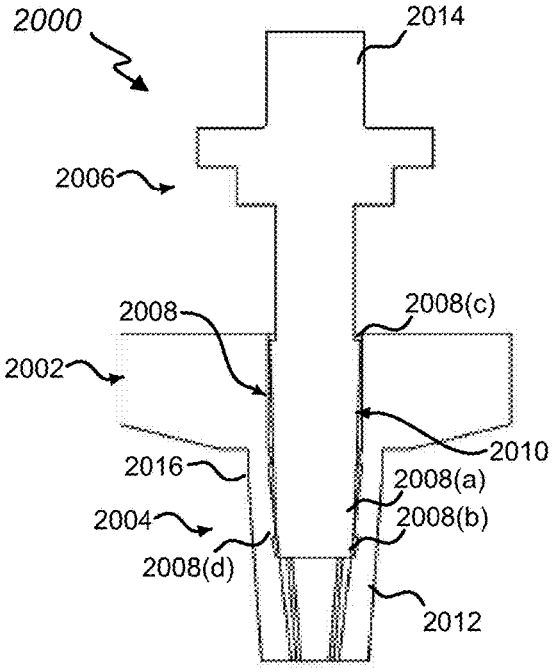
FIG. 20B depicts a cross-sectional view of the composite retention device in a partially assembled position, in accordance with certain embodiments of the present disclosure.
Figure 20C:
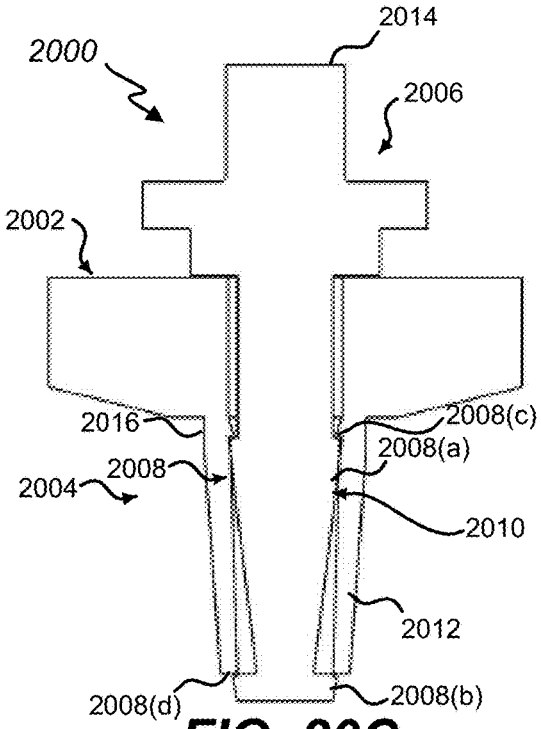
FIG. 20C depicts cross-sectional view of the retention device in an assembled position, in accordance with certain embodiments of the present disclosure.
Figure 20D:
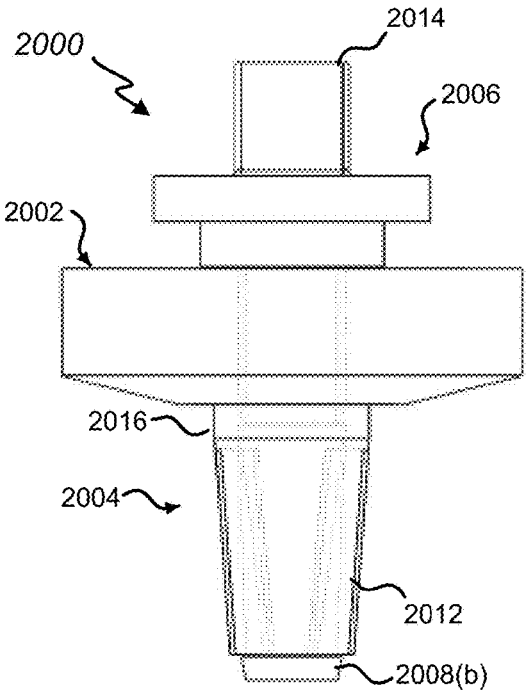
FIG. 20D depicts a side view of the composite retention device in the assembled position, in accordance with certain embodiments of the present disclosure.

Still other embodiments of retention devices are possible. For example, FIG. 20A depicts a perspective view of a composite retention device 2000, in accordance with certain embodiments of the present disclosure. FIG. 20B depicts a cross-sectional view of the composite retention device 2000 in a partially assembled position, in accordance with certain embodiments of the present disclosure. FIG. 20C depicts cross-sectional view of the retention device 2000 in an assembled position, in accordance with certain embodiments of the present disclosure. FIG. 20D depicts a side view of the composite retention device 2000 in the assembled position, in accordance with certain embodiments of the present disclosure.

Certain embodiments of the composite retention device 2000 may be a single-use system for temporarily retaining the tie plate 114 against the bottom of the rail 108 during the tie replacement process. From a high-level, some embodiments the composite retention device 2000 may include two major components: a gripper block 2005 and a push pin 2006. The gripper block 2005 may include a head section 2002 and an insert section 2004. The composite retention device 2000 may be adapted to provide a push-to-lock mechanism which causes expansion in the insert section 2004 to provide a friction fit against inside walls of the spike hole 118.

In some embodiments, the head section 2002 may be formed to have a round, tapered head, as in the example depicted. With some implementations, the head section 2002 may have a diameter of approximately 2.50 inches, but other implementations may have any other suitable dimensions. Some embodiments of the gripper block 2005 may have an overall length of approximately 2.125 inches when in the fully locked position. However, other embodiments may have any suitable overall length.

In various embodiments, the head section 2002 may be integral with, attached to, and/or otherwise adjacent to the insert section 2004. The insert section 2004 may be formed to fit in two of the spike holes 118 of the tie plate 114. The head section 2002 and the insert section 2004 may be formed to define an internal tapered bore 2010. The insert section 2004 may be formed to have an external taper 2012. The external taper 2012 may be formed to facilitate centering of the composite retention device 2000 into the spike hole 118 during insertion of the composite retention device 2000 into the spike hole 118.

The composite retention device 2000 may include a medial section 2016 below the head section 2002. The medial section 2016 may be wider than the spike hole 118 such that the medial section 2016 may provide for interference with each face of the spike hole 118 when the insert section 2004 is inserted in the spike hole 118. For example, an 0.050 inch interference or any other suitable interference may be created. The extra width at the medial section 2016 may match a dimensional increase of the spike hole 118 in its square section at the top surface of the tie plate 114 caused by the punching process when the tie plate 114 is manufactured.

The composite retention device 2000 may include a push pin 2006 having a tapered shank 2008. In some embodiments, the push pin 2006 may have a square head 2014. In some embodiments, the tapered shank 2008 may be divided into two or more distinct sections each having a different taper. In the depicted embodiment, the tapered shank 2008 is divided into two tapered sections 2008(*a*), 2008(*b*) each having a different taper. The tapered sections 2008(*a*), 2008(*b*) of the shank 2008 may be formed to provide locking barbs to snap into two or more different positions within the internal tapered bore 2010 and to drive apart one or more external surfaces of the insert section 2004. For example, in some embodiments, the tapered sections of the shank 2008 may be formed to cause expansion of four external faces of the insert section 2004 when the push pin 2006 is driven down through the internal tapered bore 2010. The internal taper of the internal tapered bore 2010 may provide for increasing interference with the push pin 2006 as the push pin 2006 is driven downward. Similarly, the external taper 2012 of outside faces of the insert section 2004 may be configured to allow clearance with each face of the spike hole 118 at the bottom edge of the insert section 2004. The clearance could, for example, be 0.035 inches or any other suitable clearance.

As an example, the taper of the internal tapered bore 2010 may cause a displacement of approximately 0.100 inch as measured at the very bottom edge of all external faces of the insert section 2004. However, various embodiments may be adapted to cause other suitable displacements. According to a set of embodiments, the taper of the internal tapered bore 2010 may coincide with the tapered shank 2008 such that the interference fit with the walls of the spike hole 118 increases by 0.014 inch from top to bottom of the insert section 2004. Other sets of embodiments may effect interference fit with different dimensions, however.

In the example illustrated, the tapered sections 2008(*a*), 2008(*b*) are formed to provide two locking barbs 2008(*c*), 2008(*d*). The first stage lock 2008(*d*) may facilitate partial assembly. The second stage lock 2008(*c*) may coincide with a fully engaged position and may generate interference against the internal faces of the internal tapered bore 2010 in order to expand the insert section 2004 to press firmly against side walls of the spike hole 118 in the tie plate 114. The first stage lock 2008(*d*) in conjunction with the second stage lock 2008(*c*) may cause a mechanical lock with the gripper block 2005 to resist separation of the gripper block 2005 and the push pin 2006 during use.

In the partially assembled position illustrated by FIG. 20B, the first stage lock 2008(*d*) may lock against a notch cut in the internal tapered bore 2010. This may allow the composite retention device 2000 to be handled as a single piece by a mechanism which may insert the composite retention device 2000 into the spike hole 118 in the field during the tie replacement process. A slight overlap of the barb diameter of the first stage lock 2008(*d*) may be slightly greater than a diameter of the notch cut in the internal tapered bore 2010. Also, certain embodiments may be formed so that there is no interference between the first stage lock 2008(*d*) and the internal surfaces of the internal tapered bore 2010 once the push pin 2006 is snapped into the partially assembled position.

In the assembled position illustrated by FIGS. 20C and 20D, the barb of the first stage lock 2008(*d*) snaps past the bottom face of the insert section 2004. In some embodiments, there may be an approximate 0.100 inch total expansion of the insert section 2004 in two directions (e.g., 0.050 inch per face). This expansion may create approximately 0.065 inch interference with each face of the spike hole 118 as measured at the very bottom edge of the insert section 2004. Midway up the insert section 2004, the interference may be approximately 0.051 inch with each face of the spike hole 118. Other embodiments may be adapted to have other dimensions of expansion and interference.

Figure 21:
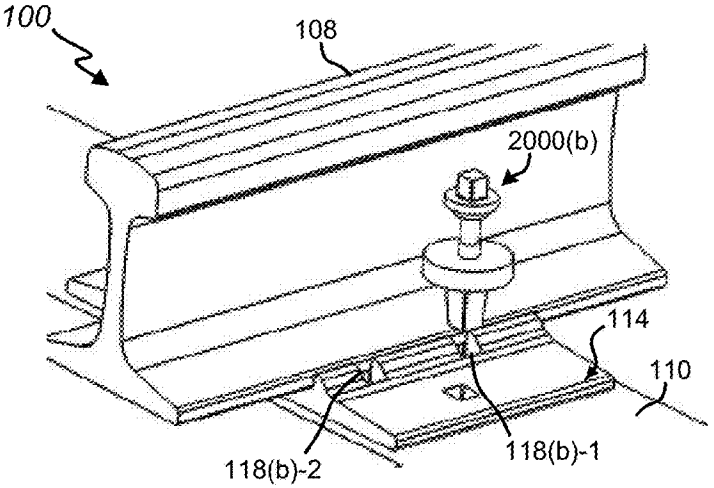
FIG. 21 depicts the perspective view of the railway portion with composite retention device illustrated in relation to the railway portion, in accordance with certain embodiments of the present disclosure.

FIG. 21 depicts the perspective view of the railway portion 100 with composite retention device 2000(*b*) illustrated in relation to the railway portion 100, in accordance with certain embodiments of the present disclosure. For the sake of explanation, the composite retention device 2000(*b*) is illustrated as suspended above corresponding spike hole pair 118(*b*).

Figure 22:
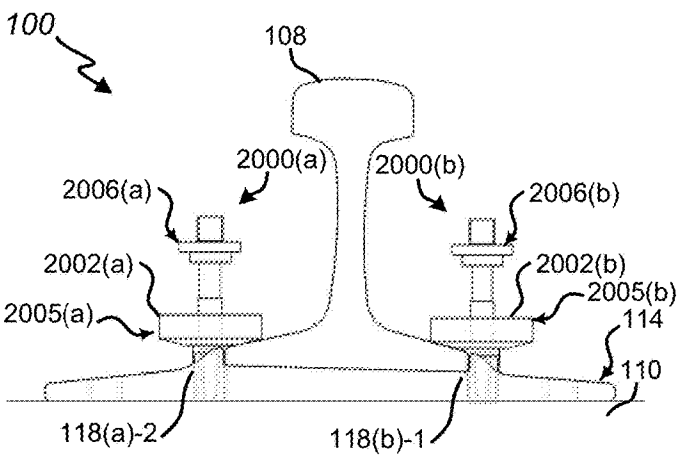
FIG. 22 depicts a partial cross-sectional view of the railway portion with retention devices illustrated in a process of insertion while the retention devices are not in a fully locked state, in accordance with certain embodiments of the present disclosure.

FIG. 22 depicts a partial cross-sectional view of the railway portion 100 with composite retention devices 2000(*a*), 2000(*b*) illustrated in a process of insertion while the retention devices 2000(*a*), 2000(*b*) are not in a fully locked state, in accordance with certain embodiments of the present disclosure. The insert sections 2004(*a*), 2004(*b*) of the composite retention devices 2000(*a*), 2000(*b*) are depicted as inserted in the spike holes 118(*a*)-1, 118(*b*)-2. The insertion could be performed after a spike-pulling step in certain instances. In other instances, the insertion could be performed before the spike-pulling step. The round, tapered head sections 2002(*a*), 2002(*b*) of the composite retention devices 2000(*a*), 2000(*b*) overlay the rail base of the rail 108 in order to hold the tie plate 114 in a static position as shown against the bottom of the rail 108. Push pins 2006(*a*), 2006(*b*) of the composite retention devices 2000(*a*), 2000(*b*) are depicted as snapped into partially assembled positions.

Figure 23:
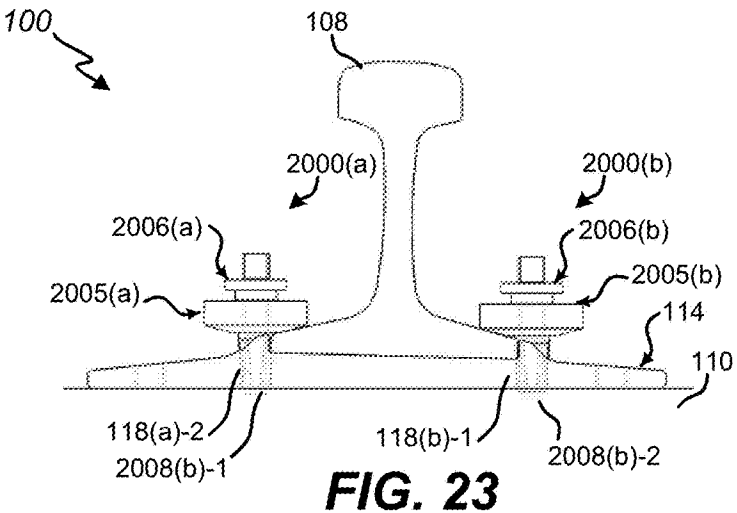
FIG. 23 depicts a partial cross-sectional view of the railway portion with the retention devices in a fully locked state, in accordance with certain embodiments of the present disclosure.

FIG. 23 depicts a partial cross-sectional view of the railway portion 100 with the composite retention devices 2000(*a*), 2000(*b*) in a fully locked state, in accordance with certain embodiments of the present disclosure. The composite retention devices 2000(*a*), 2000(*b*) are shown as fully inserted into the spike holes 118(*a*)-2, 118(*b*)-1. The push pins 2006(*a*), 2006(*b*) are in fully engaged positions. Tapered sections 2008(*b*)-1, 2008(*b*)-2 are locked into place below corresponding gripper blocks 2005(*a*), 2005(*b*). The bottom faces of the push pins 2006(*a*), 2006(*b*) and the gripper blocks 2005(*a*), 2005(*b*) may extend slightly below the bottom face of the tie plate 114. The amount of extension may be limited to minimize the amount of damage that might occur if a railway tie 110 rubs the components during extraction and/or insertion.

Figure 24:
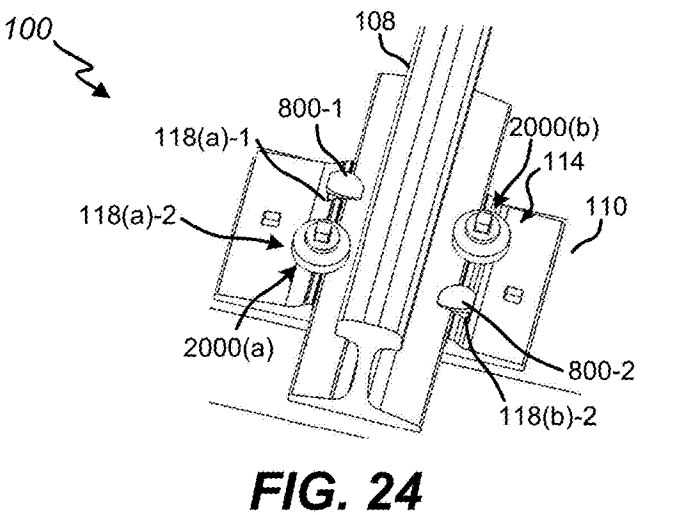
FIG. 24 depicts a partial perspective view of the railway portion with railway spikes installed in the spike holes without interference from the retention devices fully locked the alternate spike holes, in accordance with certain embodiments of the present disclosure.

FIG. 24 depicts a partial perspective view of the railway portion 100 with railway spikes 800 installed in the spike holes 118(*a*)-1, 118(*b*)-2 without interference from the composite retention devices 2000(*a*), 2000(*b*) fully locked the alternate spike holes 118(*a*)-2, 118(*b*)-1, in accordance with certain embodiments of the present disclosure. The installed composite retention devices 2000(*a*), 2000(*b*) may also be configured such that, when the railway spikes 800 are later removed, the composite retention devices 2000(*a*), 2000(*b*) do not interfere with the spike removal process. Accordingly, the composite retention devices 2000(*a*), 2000(*b*) may be permanent fasteners to retain the tie plate 114 against the rail 108 before, during, and after railway tie removal and replacement processes, as well as railway spike removal and replacement processes. Accordingly, some embodiments may be inserted into unused spike holes and left in position after a new tie has been inserted.

In some embodiments, certain retention devices herein may be made from composite/plastic, a bio-resin, and/or the like. In some embodiments, certain retention devices herein may be made from a steel material with a high yield strength, a cast iron material with a high yield strength, and/or the like. In some embodiments, the retention device may be formed at least in part by a metal cutting and/or stamping process of metal that is, for example, approximately 1/16 inch thick, 1/18 inch thick, or any one or combinations of various suitable thicknesses. Various embodiments may be adapted to hold tie plates that may weigh up to approximately 30 pounds or more with one, two, or more retention devices, in any one or combinations of configurations such as two retention devices in opposing spike holes, two retention devices in parallel spike holes, two retention devices in spike holes on the same side of the tie plate with respect to the rail, a single retention device in any spike hole, etc. Further, various embodiments may ensure adequate holding power to retain the tie plate to the bottom of the rail while an old tie is ripped out and a new tie is shoved in place under the rail. These actions can generate very high forces in one or more directions which would normally be reacted by the shoulders of the plate against the rail base if the plate is held tightly to the bottom of the rail. Certain embodiments of the retention device may hold the tie plate firmly in the vertical direction with capability to react up to approximately 5,000 lbf or more.

Therefore, various embodiments according to present disclosure are well adapted to attain the ends and advantages mentioned as well as those that are inherent therein. Specific details are given in the above description to provide a thorough understanding of the embodiments. However, it is understood that the embodiments may be practiced without these specific details. In other instances, well-known processes, structures, and techniques may be shown without unnecessary detail in order to avoid obscuring the embodiments.

The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Various embodiments may include any one or combination of features disclosed herein.

Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning. Furthermore, the use of ordinal number terms, such as "first," "second," etc., to clarify different elements in the claims is not intended to impart a particular position in a series, or any other sequential character or order, to the elements to which the ordinal number terms have been applied.

While the principles of the disclosure have been described above in connection with specific apparatuses and methods, it is to be clearly understood that this description is made only by way of example and not as limitation on the scope of the disclosure.

What is claimed is:

1. A retention device to retain a railway tie plate, the retention device comprising:

a head section comprising one or more protrusions adapted to engage a railway rail;

an insert section adjacent to the head section, wherein:

the insert section is adapted to fit in a spike hole of a railway tie plate; and the insert section comprises one or more flexible members extending from the head section, each flexible member adapted to allow flex adjustment having at least a lateral component with respect to a longitudinal axis to engage the railway tie plate when the insert section is inserted in the spike hole of the railway tie plate;

wherein the insert section fits into the spike hole of the railway tie plate so that the one or more protrusions engage the railway rail and the insert section engages the railway tie plate to mechanically interlock the railway tie plate with the railway rail to allow suspension of the railway tie plate from the railway rail without a railway tie.

2. The retention device of claim 1, wherein at least one flexible member of the one or more flexible members comprises a medial section and a foot section, the foot section disposed generally opposite of the head section, wherein the foot section comprises a lateral protrusion laterally extending with respect to the medial section and adapted to engage an underside of the railway tie plate when the insert section is inserted in the spike hole of the railway tie plate.

3. The retention device of claim 2, wherein the one or more flexible members correspond to at least two resilient spring members, each resilient spring member having a respective foot section, where the at least two resilient spring members are resilient to allow compression with respect to each other to allow insertion of each respective foot section into the spike hole of the railway tie plate and to allow expansion with respect to each other to allow each respective foot section to engage the underside of the railway tie plate when the respective foot sections extend beyond the spike hole of the railway tie plate.

4. The retention device of claim 1, wherein the head section and the insert section are formed to at least partially define an internal bore adapted to allow a railway spike to pass through the internal bore and the spike hole of the railway tie plate when the head section and the insert section is inserted in the spike hole of the railway tie plate.

5. The retention device of claim 1, wherein:

the head section comprises:

a nose section extending from a first side of the head section; and a tail section disposed generally opposite of the nose section and extending from a second side of the head section; and the head section engaging the railway rail comprises engaging the railway rail with the nose section; and the mechanical interlock is based in part on the head section engaging the tie plate with the tail section.

6. The retention device of claim 5, wherein the nose section comprises a plurality of fins, and the head section engaging the railway rail with the nose section comprises engaging the railway rail with the plurality of fins.

7. A method for a retention device to retain a railway tie plate, the method comprising:

forming a head section comprising one or more protrusions adapted to engage a railway rail;

forming an insert section adjacent to the head section, wherein:

the insert section is adapted to fit in a spike hole of a railway tie plate; and the insert section comprises one or more flexible members extending from the head section, each flexible member adapted to allow flex adjustment having at least a lateral component with respect to a longitudinal axis to engage the railway tie plate when the insert section is inserted in the spike hole of the railway tie plate; and adapting the head section and the insert section so that when the insert section fits into the spike hole of the railway tie plate so that the one or more protrusions engage the railway rail and the insert section engages the railway tie plate to mechanically interlock the railway tie plate with the railway rail to allow suspension of the railway tie plate from the railway rail without a railway tie.

8. The method of claim 7, the forming the insert section comprising:

forming at least one flexible member of the one or more flexible members to have a medial section and a foot section, the foot section disposed generally opposite of the head section, wherein the foot section comprises a lateral protrusion laterally extending with respect to the medial section and adapted to engage an underside of the railway tie plate when the insert section is inserted in the spike hole of the railway tie plate.

9. The method of claim 8, wherein the one or more flexible members correspond to at least two resilient spring members, each resilient spring member having a respective foot section, where the at least two resilient spring members are resilient to allow compression with respect to each other to allow insertion of each respective foot section into the spike hole of the railway tie plate and to allow expansion with respect to each other to allow each respective foot section to engage the underside of the railway tie plate when the respective foot sections extend beyond the spike hole of the railway tie plate.

10. The method of claim 7, wherein the head section and the insert section are formed to at least partially define an internal bore adapted to allow a railway spike to pass through the internal bore and the spike hole of the railway tie plate when the head section and the insert section is inserted in the spike hole of the railway tie plate.

11. The method of claim 7, wherein:

the forming the head section comprises:

forming a nose section extending from a first side of the head section; and forming a tail section disposed generally opposite of the nose section and extending from a second side of the head section; and the head section engaging the railway rail comprises engaging the railway rail with the nose section; and the mechanical interlock is based in part on the head section engaging the tie plate with the tail section.

12. The method of claim 11, wherein forming the nose section comprises forming a plurality of fins, and wherein the head section engaging the railway rail with the nose section comprises engaging the railway rail with the plurality of fins.

13. A method for a retention device to retain a railway tie plate, the method comprising:

mechanically interlocking, with a retention device, a railway tie plate with a railway rail to allow suspension of the railway tie plate from the railway rail, where the retention device comprises:

a head section comprising one or more protrusions adapted to engage a railway rail;

an insert section adjacent to the head section, wherein:

the insert section is adapted to fit in a spike hole of the railway tie plate; and the insert section comprises one or more flexible members extending from the head section, each flexible member adapted to allow flex adjustment having at least a lateral component with respect to a longitudinal axis to engage the railway tie plate when the insert section is inserted in the spike hole of the railway tie plate;

wherein the insert section fits into the spike hole of the railway tie plate so that the one or more protrusions engage the railway rail and the insert section engages the railway tie plate to mechanically interlock the railway tie plate with the railway rail to allow suspension of the railway tie plate from the railway rail without a railway tie.

14. The method of claim 13, wherein at least one flexible member of the one or more flexible members to have a medial section and a foot section, the foot section disposed generally opposite of the head section, wherein the foot section comprises a lateral protrusion laterally extending with respect to the medial section and adapted to engage an underside of the railway tie plate when the insert section is inserted in the spike hole of the railway tie plate.

15. The method of claim 14, wherein the one or more flexible members correspond to at least two resilient spring members, each resilient spring member having a respective foot section, where the at least two resilient spring members are resilient to allow compression with respect to each other to allow insertion of each respective foot section into the spike hole of the railway tie plate and to allow expansion with respect to each other to allow each respective foot section to engage the underside of the railway tie plate when the respective foot sections extend beyond the spike hole of the railway tie plate.

16. The method of claim 13, wherein the head section and the insert section are formed to at least partially define an internal bore adapted to allow a railway spike to pass through the internal bore and the spike hole of the railway tie plate when the head section and the insert section is inserted in the spike hole of the railway tie plate.

* * * * *